US010718098B1

(12) United States Patent
Hager et al.

(10) Patent No.: US 10,718,098 B1
(45) Date of Patent: Jul. 21, 2020

(54) STAND-ON OR WALK-BEHIND UTILITY LOADER WITH VARIABLE LENGTH LIFT ARM ASSEMBLY

(71) Applicant: THE TORO COMPANY, Bloomington, MN (US)

(72) Inventors: Joseph P. Hager, Golden Valley, MN (US); Timothy J. Berg, Mendota Heights, MN (US); David A. Murray, Eagan, MN (US); Caleb A. Olson, Roseville, MN (US); Scott T. Hoffman, Prior Lake, MN (US); Jeffrey R. Frank, Bloomington, MN (US)

(73) Assignee: THE TORO COMPANY, Bloomington, MN (US)

( * ) Notice: Subject to any disclaimer, the term of this patent is extended or adjusted under 35 U.S.C. 154(b) by 4 days.

(21) Appl. No.: 15/465,980

(22) Filed: Mar. 22, 2017

Related U.S. Application Data

(60) Provisional application No. 62/312,819, filed on Mar. 24, 2016.

(51) Int. Cl.
*E02F 3/34* (2006.01)
*E02F 9/20* (2006.01)
(Continued)

(52) U.S. Cl.
CPC ..... *E02F 3/3414* (2013.01); *E02F 3/3417* (2013.01); *E02F 9/02* (2013.01);
(Continued)

(58) Field of Classification Search
CPC ..... E02F 3/3414; E02F 3/3417; E02F 3/845; E02F 3/907; E02F 9/14; E02F 9/2004;
(Continued)

(56) References Cited

U.S. PATENT DOCUMENTS 2,990,072 A 6/1961 Mindrum
3,178,046 A * 4/1965 Lull ..... B66F 9/0655 414/718

(Continued)

FOREIGN PATENT DOCUMENTS

CN 203247619 U 10/2013
FR 2 522 636 A1 9/1983
GB 2 079 246 A 1/1982

OTHER PUBLICATIONS

Grayson, "This is Teleskid: Check our JCB's new half skid steer, half telehandler before its official ConExpo launch (video)" Equipment World [online]. [retrieved on Jan. 4, 2018]. Retrieved from the Internet: <URL: equipmentworld.com/this-is-teleskid-check-out-jcbs-new-half-skid-steer-half-telehandler-before-its-official-conexpo-launch-video/ >. Feb. 21, 2017. 5 pages.

(Continued)

*Primary Examiner* — Ronald P Jarrett
(74) *Attorney, Agent, or Firm* — Mueting, Raasch & Gebhardt, P.A.

(57) ABSTRACT

A utility loader incorporating a boom of adjustable length. The boom may include either or both of a left and right lift arm assembly, with each lift arm assembly including a rear lift arm that telescopically receives a front lift arm. Each lift arm assembly also includes an extension actuator adapted to telescopically extend and retract its front lift arm relative to its rear lift arm. A detection system may be provided and adapted to limit lift arm assembly extension based at least in part upon a load applied at a tool supported by the boom and a relative telescopic location of a front lift arm relative to its associated rear lift arm.

21 Claims, 16 Drawing Sheets

(51) Int. Cl.

| | |
|---|---|
| ***E02F 9/22*** | (2006.01) |
| ***E02F 9/26*** | (2006.01) |
| ***E02F 9/02*** | (2006.01) |
| ***E02F 9/14*** | (2006.01) |

(52) U.S. Cl.
CPC ..... *E02F 9/14* (2013.01); *E02F 9/2004* (2013.01); *E02F 9/2271* (2013.01); *E02F 9/264* (2013.01)

(58) Field of Classification Search
CPC ..... E02F 9/264; B62D 55/104; B62D 55/084; B62D 11/20; B66C 21/90; B66C 23/90
USPC ..... 180/9.46; 212/276, 277, 278
See application file for complete search history.

(56) References Cited

U.S. PATENT DOCUMENTS

| | | | |
|---|---|---|---|
| 4,162,873 | A | 7/1979 | Smith, Jr. |
| 4,553,899 | A | 11/1985 | Magni |
| 4,645,264 | A | 2/1987 | Morrison |
| 5,423,654 | A | 6/1995 | Rohrbaugh |
| 5,542,814 | A | 8/1996 | Ashcroft et al. |
| 6,695,568 | B2 | 2/2004 | Bares et al. |
| 6,698,114 | B2 | 3/2004 | Bares et al. |
| 6,709,223 | B2 | 3/2004 | Walto et al. |
| 6,726,437 | B2 | 4/2004 | Albright et al. |
| 7,980,569 | B2 | 7/2011 | Azure et al. |
| 8,464,819 | B2 | 6/2013 | Major et al. |
| 8,965,637 | B2 | 2/2015 | Brooks et al. |
| 9,073,739 | B2 | 7/2015 | Woods et al. |
| 2010/0168933 | A1 | 7/2010 | Rorabaugh |
| 2016/0169413 | A1* | 6/2016 | Camacho ..... F16L 1/06 701/50 |
| 2016/0244937 | A1 | 8/2016 | Azure et al. |
| 2017/0101143 | A1* | 4/2017 | Thomas ..... B62D 55/1083 |

OTHER PUBLICATIONS

"Forklift | Forklift Truck | JCB Teletruk" Web page [online]. [retrieved on Apr. 4, 2018] Retrieved from the Internet: <URL: http://web.archive.org/web/20160316205956/http://www.jcbna.com/products/Machines/Teletruk.aspx>. Mar. 16, 2016; 4 pages.

"JCB Skid Steer Loader" Web page [online]. [retrieved on Apr. 4, 2018]. Retrieved from the Internet: <URL: https://web.archive.org/web/20160319034244/http://www.jcbna.com/products/Machines/Skid-Steer-Loader.aspx >. Mar. 19, 2016; 5 pages.

"JCB Telescopic Handlers" Web page [online]. [retrieved on Apr. 4, 2018]. Retrieved from the Internet: <URL: https://web.archive.org/web/20160317225850/http://www.jcbna.com:80/products/Machines/Telescopic-Handlers.aspx>. Mar. 17, 2016; 5 pages.

Merlo Cingo, "CINGO Big Versatile Transporters" Product Brochure. Merlo S.p.A. Cuneo, Italy. Copyright Mar. 2009; 16 pages.

Toro "Toro Dingo TX Tracked Models," Product Brochure. The Toro Company [online]. [retrieved on Jan. 12, 2018]. Retrieved from the Internet: <URL: toro.com/professional/sws/brochure/1a_Dingo.pdf>. Copyright 2008; Cover Page and pp. 4-5.

Toro "Toro Dingo TX 413 and Trailer," Product Brochure. The Toro Company. The Toro Company [online]. [retrieved on Jan. 12, 2018]. Retrieved from the Internet: <URL: toro.com/professional/sws/brochure/1a_Dingo.pdf>. Copyright 2008; Cover Page and pp. 6-7.

U.S. Appl. No. 62/312,819, filed Mar. 24, 2016, Hager et al.

Toro "Toro Dingo Compact Utility Loaders," Product Brochure. The Toro Company [online]. [retrieved on Jan. 12, 2018]. Retrieved from the Internet: <URL: toro.com/professional/sws/brochure/1a_Dingo.pdf. Copyright 2008; 20 Pages.

* cited by examiner

STAND-ON OR WALK-BEHIND UTILITY LOADER WITH VARIABLE LENGTH LIFT ARM ASSEMBLY

This application claims the benefit of U.S. Provisional Application No. 62/312,819, filed Mar. 24, 2016, which is incorporated herein by reference in its entirety.

Embodiments of the present disclosure relate to stand-on or walk-behind utility loaders and to such loaders having variable length lift arms.

BACKGROUND

Utility loaders controlled by a stand-on or walk-behind operator (such loaders being referred to herein as "SOWB loaders") are known for performing various types of work in an outdoor environment. While able to perform the types of work often associated with large skid steer loaders, SOWB loaders are generally smaller in size. Moreover, SOWB loaders do not carry an operator in a seated position as do larger skid steer loaders. Instead, they are most often operated by an operator who stands on a platform attached to the rear of the loader or, alternatively, walks on the ground behind the loader.

SOWB loaders typically employ a differential drive and steering system in which drive members (e.g., wheels or tracks) on opposite (left and right) sides of the loader may be driven at different speeds and/or in opposite directions. When the drive members are driven at different speeds and in the same direction, the loader will execute a turn towards the side of the slowest drive member. When the drive members are driven at the same speed but in opposite directions, the loader will execute a very sharp spin or zero radius turn about a vertical axis located between the drive members. This is accomplished using separate traction drives (e.g., individual hydrostatic transmissions) to independently power the left and right drive members. Dual traction or drive control levers are often used to independently control the traction drives. These control levers are pivotal in fore-and-aft directions from a neutral position in which the traction drives are unpowered and the loader is stationary. When the levers are equally pushed forwardly from neutral, the loader will move forwardly in a straight line at a speed proportional to the distance that the levers have been moved. Similarly, when the levers are equally pulled rearwardly from neutral, the loader will move rearwardly in a straight line at a speed proportional to the distance that the levers have been moved rearwardly. Again, by independently moving the two control levers, turns of varying degrees may be accommodated.

Modern SOWB loaders are able to accept a variety of working tool attachments that attach to a boom extending from a frame of the loader. The boom is typically formed by one or more lift arms that extend forward from the loader and include a mounting structure capable of receiving and supporting the attachment. The lift arms are typically pivotally attached to the loader and, via an actuator such as one or more hydraulic cylinders, may be pivoted relative to the loader such that the elevation of the attachment may be varied. In some loaders, the mounting structure may also pivot, relative to the lift arms, to adjust the orientation of the attachment relative to the lift arms.

While effective for their intended purpose, SOWB loaders are sometimes constrained in operation by their size and, in particular, by the limited reach of the lift arms.

SUMMARY

Embodiments of the present disclosure may provide a utility loader that includes: a lift frame carrying a prime mover, the lift frame including left and right sides; ground engaging members operatively attached to the lift frame, wherein at least one of the ground engaging members is powered by the prime mover to propel the lift frame over a ground surface; and a control console located at or near a rear end of the lift frame, the control console carrying controls adapted to be manipulated by an operator either: standing on a platform mounted near the rear end of the lift frame; or walking behind the lift frame. The loader may further include a lift arm assembly attached to at least one of the left and right sides of the lift frame, wherein the prime mover is positioned on the lift frame at a location lateral to the lift arm assembly. The lift arm assembly includes: an elongate rear lift arm including a front end and a rear end, wherein the rear end of the rear lift arm is pivotally attached to the lift frame at a transverse lift arm pivot axis; an elongate front lift arm also including a front end and a rear end, wherein the rear end of the front lift arm is telescopically received in the front end of the rear lift arm such that a distance between the rear end of the rear lift arm and the front end of the front lift arm is variable; and an extension actuator adapted to extend or retract the front lift arm relative to the rear lift arm. The loader may further include a working tool carried on the front end of the front lift arm.

In another embodiment, a utility loader is provided that includes: a lift frame carrying a prime mover; ground engaging members operatively attached to the lift frame, wherein at least one of the ground engaging members is powered by the prime mover to propel the lift frame over a ground surface; and a control console located at or near a rear end of the lift frame, the control console carrying controls adapted to be manipulated by an operator either standing on a platform mounted near the rear end of the lift frame, or walking behind the lift frame. The loader further includes left and right lift arm assemblies attached to left and rights sides of the lift frame, respectively, wherein the prime mover is located at a position on the lift frame that is between the left and right lift arm assemblies. Each of the left and right lift arm assemblies includes: an elongate rear lift arm including a front end and a rear end, wherein the rear end of the rear lift arm is pivotally attached to the respective side of the lift frame at a transverse lift arm pivot axis; an elongate front lift arm also including a front end and a rear end, wherein the rear end of the front lift arm is telescopically received in the front end of the rear lift arm such that a distance between the rear end of the rear lift arm and the front end of the front lift arm is variable; and an extension actuator adapted to extend or retract the front lift arm relative to the rear lift arm. The loader may further include a working tool carried on the front ends of the front lift arms.

In yet another embodiment, a utility loader is provided that includes: a lift frame comprising a front end and a rear end, the lift frame carrying a prime mover; a track frame comprising ground engaging members, wherein the track frame is pivotally attached to the lift frame such that the track frame pivots, relative to the lift frame, about a front pivot axis proximate the front end of the lift frame, the track frame further comprising an arm pivotally and translatably connected to the lift frame at a rear track pivot; a detector connected with one of the lift frame and the arm, the detector located proximate the rear end of the lift frame; and a target connected with the other of the lift frame and the arm. The loader further includes: a platform attached to the rear end of the lift frame; a control console located at or near the rear end of the lift frame; and left and right lift arm assemblies attached to left and rights sides of the lift frame, respectively. Each of the left and right lift arm assemblies includes: an elongate rear lift arm including a front end and a rear end, wherein the rear end of the rear lift arm is pivotally attached to the respective side of the lift frame at a transverse lift arm pivot axis; an elongate front lift arm also including a front end and a rear end, wherein the rear end of the front lift arm is telescopically received in the front end of the rear lift arm such that a distance between the rear end of the rear lift arm and the front end of the front lift arm may be varied; a lift actuator connected to the lift frame and to the rear lift arm, the lift actuator adapted to pivot the rear lift arm relative to the lift frame about the transverse lift arm pivot axis; and an extension actuator connected to the rear lift arm and the front lift arm, the extension actuator adapted to extend and retract the front lift arm relative to the rear lift arm. The loader may further include a working tool carried on the front ends of the left and right front lift arms.

The above summary is not intended to describe each embodiment or every implementation. Rather, a more complete understanding of illustrative embodiments will become apparent and appreciated by reference to the following Detailed Description of Exemplary Embodiments and claims in view of the accompanying figures of the drawing.

BRIEF DESCRIPTION OF THE VIEWS OF THE DRAWING

Exemplary embodiments will be further described with reference to the figures of the drawing, wherein:

FIGS. 14A-14B are partially cutaway side elevation views of the loader of FIG. 1 illustrating a tilt or pitch detection system in accordance with one embodiment of this disclosure, wherein: FIG. 14A illustrates the system when tool loading and lift arm assembly extension are such that a predetermined threshold is not satisfied; and FIG. 14B illustrates the system when tool loading and lift arm assembly extension are such that the predetermined threshold is satisfied.

Figure 1:
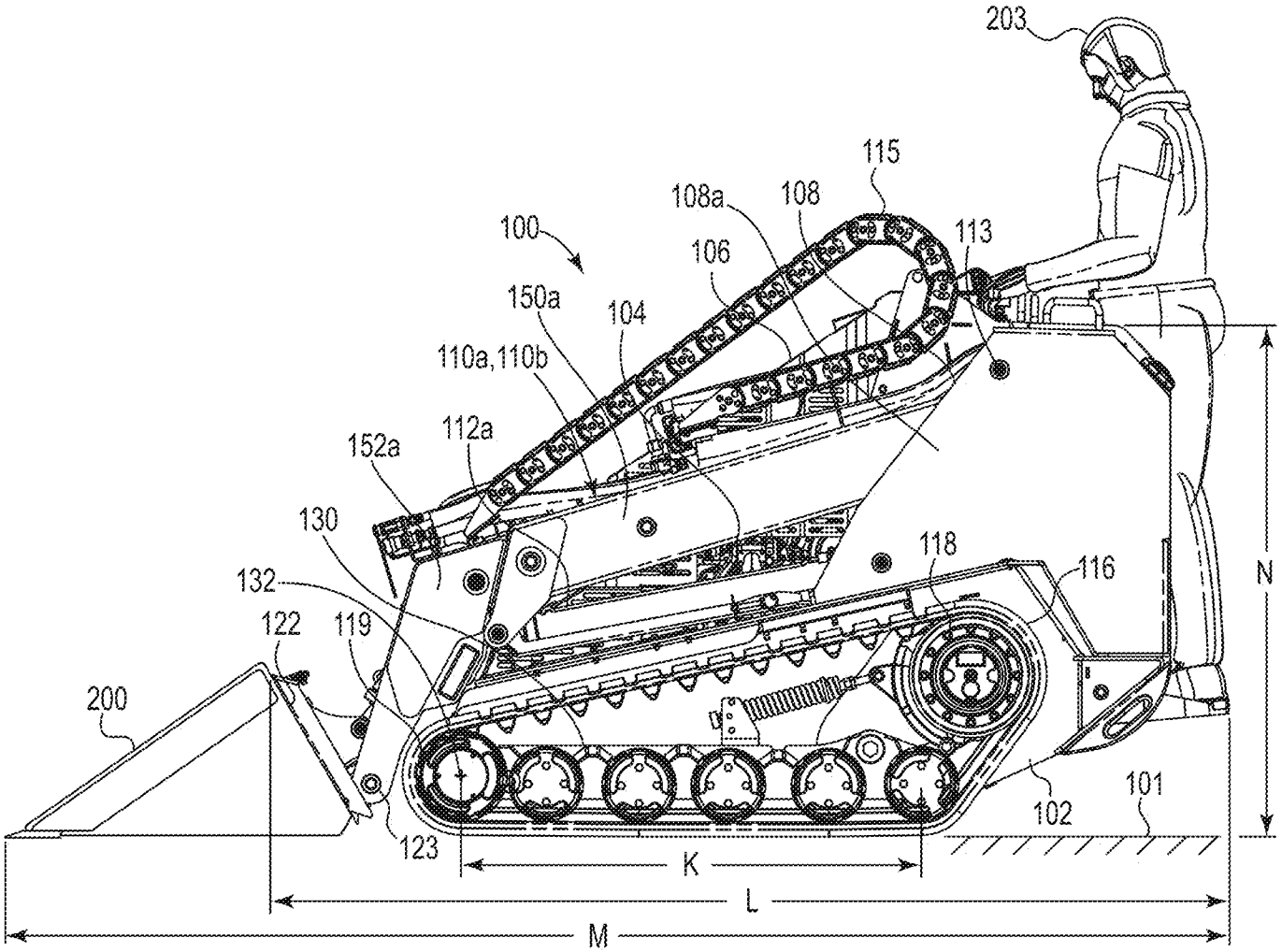
FIG. 1 is a side elevation view of a SOWB loader in accordance with one embodiment of this disclosure, the loader shown with left and right lift arm assemblies supporting a bucket at a minimum or fully lowered position, the lift arm assemblies further shown in a fully retracted position.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described herein. The lack of illustration/description of such structure/components in a particular figure is, however, not to be interpreted as limiting the scope of the various embodiments in any way. Still further, "Figure x" and "FIG. x" may be used interchangeably herein to refer to the figure numbered "x."

DETAILED DESCRIPTION OF EXEMPLARY EMBODIMENTS

In the following detailed description of illustrative embodiments, reference is made to the accompanying figures of the drawing which form a part hereof. It is to be understood that other embodiments, which may not be described and/or illustrated herein, are certainly contemplated.

All headings provided herein are for the convenience of the reader and should not be used to limit the meaning of any text that follows the heading, unless so specified. Moreover, unless otherwise indicated, all numbers expressing quantities, and all terms expressing direction/orientation (e.g., vertical, horizontal, parallel, perpendicular, etc.) in the specification and claims are to be understood as being modified in all instances by the term "about." Furthermore, the terms "comprises" and variations thereof do not have a limiting meaning where these terms appear in this description and claims, and the terms "a," "an," "the," "at least one," and "one or more" are used interchangeably herein.

Still further, relative terms such as "left," "right," "front," "fore," "forward," "rear," "aft," "rearward," "top," "bottom," "side," "upper," "lower," "above," "below," "horizontal," "vertical," and the like may be used herein and, if so, are from the perspective of one operating the loader 100 while the loader is in an operating configuration, e.g., while it is positioned such that tracks 116 rest upon a generally horizontal ground surface 101 as shown in FIG. 1. These terms are used only to simplify the description, however, and not to limit the interpretation of any embodiment described.

Embodiments described and illustrated herein are directed to a utility loader that accommodates an operator either: standing upon a platform attached to the loader (e.g., at a back end of the loader); or optionally, walking behind the loader. For brevity, such loaders may be referred to herein as a "SOWB loader" or, more generically, as a "loader." Such loaders may include a boom for supporting and operating various attachments or working tools. However, unlike most SOWB loaders, loaders as described herein may include a boom that not only pivots relative to a frame of the loader, but may also effectively change length as needed. As a result, loaders are provided having improved tool reach and elevation. Furthermore, SOWB loaders in accordance with embodiments of the present disclosure may also include a pitch (e.g., tilt) detection system adapted to detect when a tilting moment applied to the loader, e.g., by a tool load, exceeds a predetermined threshold.

Figure 9:
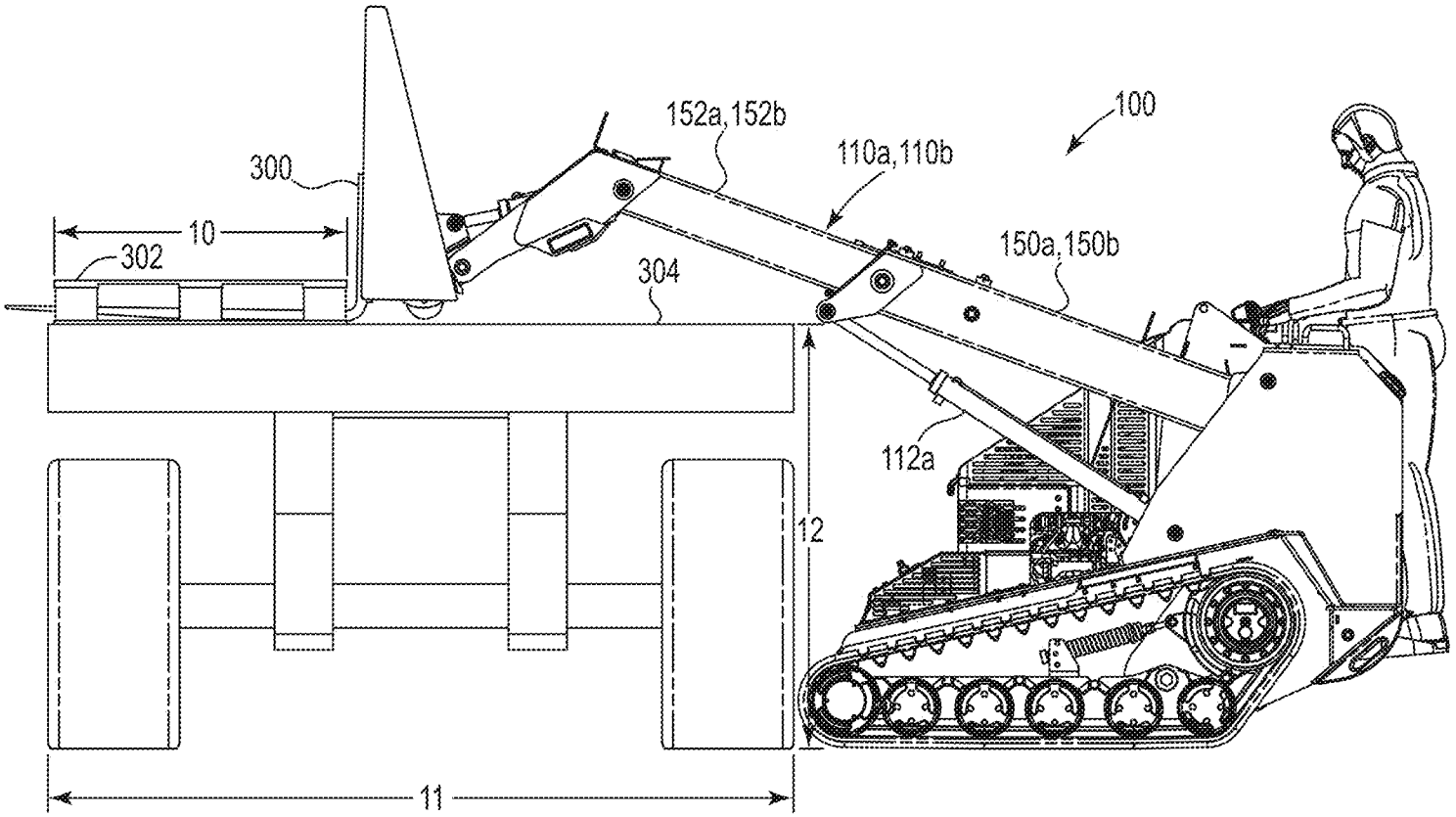
FIG. 9 is a side elevation view of a SOWB loader in accordance with another embodiment of the disclosure, wherein the left and right lift arm assemblies support a fork lift tool, the lift arm assemblies shown in the fully extended position and at an intermediate elevated position.
Figure 10:
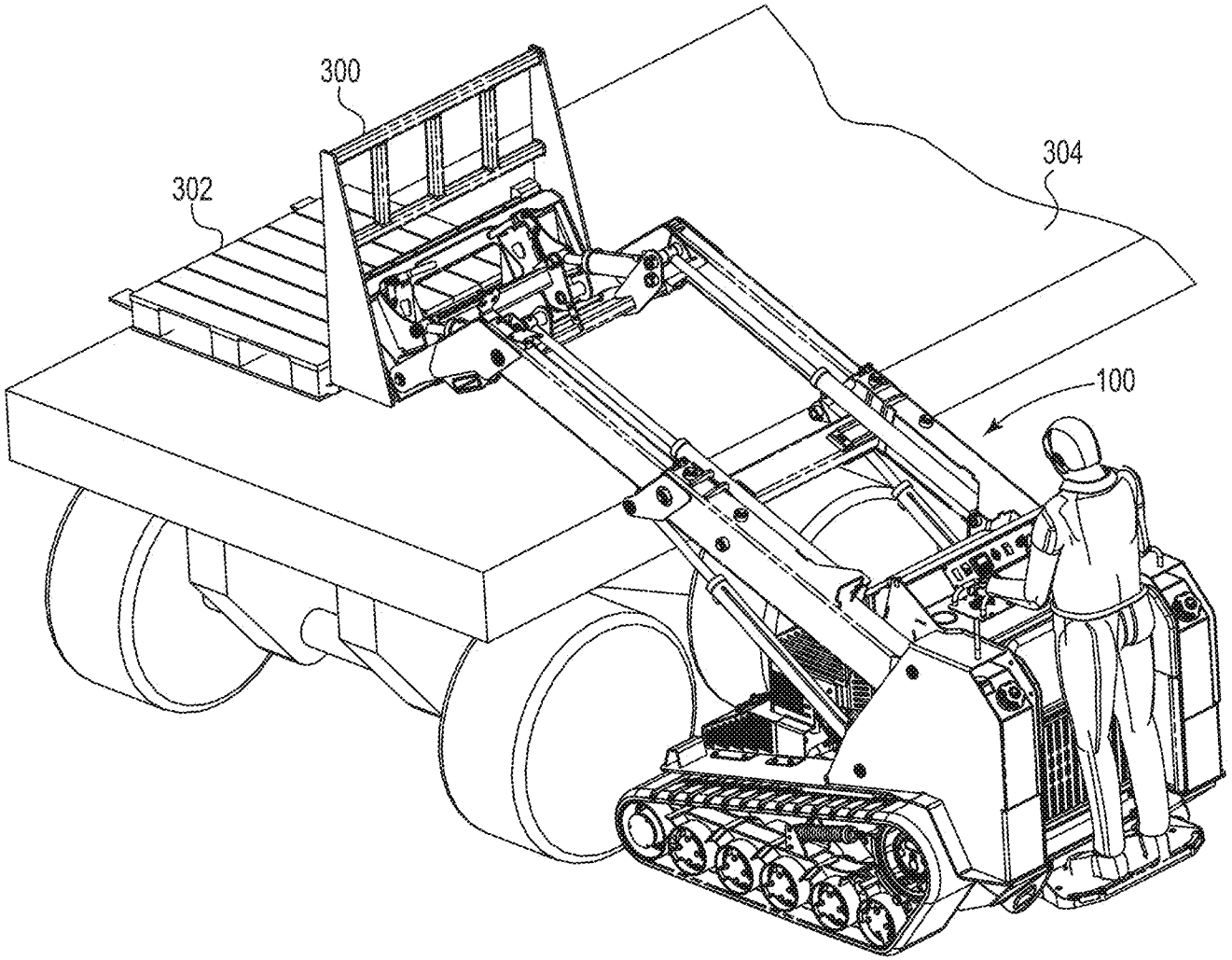
FIG. 10 is a perspective view of the loader of FIG. 9.

With reference to the figures of the drawing, wherein like reference numerals designate like parts and assemblies throughout the several views, FIGS. 1-4 illustrate a SOWB loader 100 in accordance with embodiments of the present disclosure. The loader 100 may be similar in some respects to the Dingo TX series utility loader sold by The Toro Company of Minneapolis, Minn., USA. The loader 100 may accommodate a variety of working tools or attachments used, e.g., by landscape contractors, to perform various tasks. For example, a bucket 200 can be attached to the loader 100 for scooping, carrying, and emptying (e.g., into a dump truck) dirt or other material. The loader 100 may accommodate other tools including, for example, forks (fork lift, see FIGS. 9-10), a vibratory plow, a grapple rake, a trencher, a leveler, a box rake, a soil cultivator, a snowthrower, a stump grinder, a tiller, an auger, and a plow blade among others.

While SOWB loaders like those described herein may vary in size, an exemplary loader in accordance with embodiments of the present disclosure may be of a size that permits the loader to access areas generally inaccessible by larger skid steer loaders (e.g., areas with confined entries such as gates, or areas unable to support the weight of a typical skid steer loader). For example, an SOWB loader like that shown in FIG. 1 may have a fore-and-aft, ground engagement contact pad K (e.g., ground/track engagement) of 60 inches or less, an overall length L (without tool) of 110 inches or less, a height N of 80 inches or less, and a maximum width O (see FIG. 4) of 60 inches or less. For instance, the loader 100 of FIG. 1 may have a ground engagement contact pad K of 50 inches, a length L of 103 inches (and a length M of 130 inches with the bucket 200 attached), a height N of 61 inches (corresponding to a height of 67 inches at the top of the carrier 115), and a width O of 54 inches. However, such specific dimensions are exemplary only and SOWB loaders of other sizes are certainly contemplated within the scope of this disclosure.

The exemplary loader 100 may be configured in a stand-on configuration using a platform 202 (see FIG. 4) to accommodate a standing operator 203. In other embodiments, the platform 202 could be stowable so as not to interfere with walk-behind operation. One embodiment of such a stowable platform is shown in U.S. Pat. No. 7,980,569.

The loader 100 may include a suitably shaped chassis or frame (e.g., lift frame 102) on which a prime mover, such as an internal combustion engine 104, is carried. A hood or shroud 106 may at least partially enclose the engine 104. The lift frame 102 may include laterally spaced uprights 108 on each (left and right) side of the loader. The lift frame 102 may support a boom that includes left and right lift arm assemblies 110 (110*a*, 110*b*, see also FIG. 4). The left and right lift arm assemblies 110*a*, 110*b* may each include a rear end pivotally connected to the left and right sides or uprights 108*a*, 108*b* of the lift frame, respectively, and extend generally forward of a front end of the loader 100. A lift actuator 112, e.g., hydraulic cylinder (only cylinder 112*a* visible in FIG. 1, but see cylinder 112*b* in FIG. 4), may be connected between the lift frame 102 and each lift arm assembly 110 (e.g., between the lift frame 102 and a front end of a rear lift arm 150 as illustrated herein). When piston rods of the lift actuators 112 are extended, the lift arm assemblies 110 may pivot about a transverse lift arm pivot axis 113 to raise or lift distal (e.g., front) ends of the lift arm assemblies 110 relative to the ground surface 101/lift frame 102. Likewise, when the piston rods of the lift actuators 112 are retracted, the lift arm assemblies 110 may pivot in the opposite direction about the transverse lift arm pivot axis 113 to lower the distal ends of the arms.

The suffixes "a" and "b" may be used throughout this description to denote various left- and right-side parts/features, respectively. However, in most pertinent respects, the parts/features denoted with "a" and "b" suffixes are substantially identical to, or mirror images of, one another. It is understood that, unless otherwise noted, the description of an individual part/feature (e.g., part/feature identified with an "a" suffix) also applies to the opposing part/feature (e.g., part/feature identified with a "b" suffix). Similarly, the description of a part/feature identified with no suffix may apply, unless noted otherwise, to both the corresponding left and right part/feature.

In the embodiments described and illustrated herein, the various actuators (e.g., the lift actuators 112, extension actuators 154 (described below), and tilt actuators 124 (also described below)) may be configured as hydraulic cylinders. However, the term "actuator," as used herein, may refer to most any electric, hydraulic, or pneumatic device capable of providing movement of one element relative to another. For example, a linear electric actuator, or a hydraulic or electric rotary motor driving a pinion in a rack-and-pinion system, may be utilized in place of the hydraulic cylinders described herein without departing from the scope of this disclosure.

The loader 100 may further include a traction system that includes both left and right ground engaging members that, in one embodiment, are formed by tracks 116 (only left track visible in FIG. 1, but right track (and track frame) is a mirror image) operatively attached to the lift frame 102 (while shown as tracks, other embodiments may use ground-engaging wheels or any other device capable of providing propulsion power to the loader). In one or more embodiments, the loader may include left and right track frames 130 (e.g., see isolated right track frame in FIG. 13) that support the left and right tracks 116, respectively, wherein the track frames 130 may be operatively attached to the lift frame 102. For example, each track frame 130 may be pivotally attached to the lift frame 102 via a front mounting shaft defining a front pivot axis 132 (see FIG. 1) located proximate a front end of the lift frame 102. As such, the lift frame 102 may pivot during operation relative to the track frame 130 about the front pivot axis 132 as further described below.

With reference still to FIGS. 1-4, each track 116 may be connected to its own, independent drive unit (e.g., hydraulic motor) powered by the engine 104 such that the loader may be propelled over the ground surface 101. In the illustrated embodiments, each track 116 may be configured as an endless, flexible belt that is looped or entrained around a plurality of idlers 119 and a drive wheel 118, the latter being at an elevation above the idlers. Each track 116 may include inwardly extending drive lugs that engage apertures or openings formed in at least the drive wheel 118 so that rotation of the drive wheel 118 results in linear movement of the track 116. In other embodiments, each drive wheel 118 could instead define a sprocket with sprocket teeth operable to engage notches formed in the associated track 116. In fact, most any track configuration now known or later developed is possible without departing from the scope of this disclosure. As stated above, in still other embodiments, the tracks 116 could be replaced with wheels.

As is known in the art, each hydraulic motor may rotate its respective drive wheel 118 in either a forward or reverse direction to permit corresponding propulsion of the loader 100 forwardly (to the left in FIG. 1) or rearwardly (to the right in FIG. 1). As each drive wheel 118 may be powered by its own independent motor, steering control of the loader 100 may be achieved by varying the relative rotational speed and direction of each drive wheel, and thus the speed and direction of each track 116.

The loader 100 may further include a control console 120 (see FIGS. 4 and 11) that, in the illustrated embodiment, is located at or near the rear end of the loader 100 (e.g., at or near the rear end of the lift frame 102) proximate the upper ends of the uprights 108. The control console 120 may include various controls, e.g., levers, switches, buttons, etc., that control loader operation. For example, the control console 120 may include controls that cause various actuators to energize (e.g., cause lift actuators 112 to extend and thus pivot the lift arm assemblies 110 from a lowered position (FIG. 1) through an intermediate elevated position (e.g., see FIG. 2) to a maximum elevated position (see FIG. 3)). In addition, the control console 120 may include a movable drive control handle to allow operator control of the traction system that drives the tracks 116. One exemplary control system that may be adapted for use with embodiments of the present disclosure is described in detail in US Pat. App. Publ. No. 2016-0244937.

As mentioned above, working tools (e.g., such as bucket 200) may be connected to a mounting structure, e.g., attachment plate 122, pivotally connected to front or distal ends of the lift arm assemblies 110. To ease the task of removing and installing tools on the attachment plate 122, various quick attachment systems may be used as are known in the art. Such attachment plates may conform to industry standards such as SAE J2513 (2000).

In some embodiments, the attachment plate 122 is pivotally connected to the front ends of the lift arm assemblies (e.g., at a transverse pivot joint/axis 123) so that an orientation (e.g., angle of inclination) of the attachment plate (and thus the tool itself) may be adjusted as the lift arm assemblies are raised and lowered. Tilt actuators 124 (124*a*, 124*b*, see FIG. 4), which may be configured as left and right hydraulic cylinders, may extend between the attachment plate 122 and the lift arm assemblies 110. As the tilt actuators 124 extend and retract, the angle of inclination of the attachment plate (about the pivot axis 123 and relative to lift arm assemblies) may change. Thus, by controlling the vertical position of the lift arm assemblies 110 (via the lift actuators 112), and by controlling the angle of inclination of the attachment plate 122 (via the tilt actuators 124) relative to the lift arm assemblies, the operator may position the tool within a wide range of elevations and inclinations. While shown as utilizing two tilt actuators 124, other embodiments may use a single tilt actuator, or event three or more tilt actuators without departing from the scope of this disclosure.

During operation, the operator may stand upon the platform 202 as shown in the figures (or, in other embodiments, walk behind the lift frame 102). The control console 120 may be positioned at a convenient height so that it remains accessible to the operator from this standing position. In combination with the forward location of the lift arm pivot axis 113, SOWB utility loaders may provide the operator with desirable sight lines to both the tool area and the areas immediately surrounding the operator.

Advantageously, loader 100 may use laterally offset (laterally offset to the left and right from a longitudinal axis 111 (see FIG. 4) of the loader/lift frame) lift arm assemblies (or, as described below, a single, offset lift arm assembly) and an operator position that is generally centered between the left and right lift arm assemblies 110*a*, 110*b*. Such a configuration (as well as configurations using a single offset arm as described below) may allow less obstructed visibility of the tool area when compared to, for example, loader configurations utilizing a single, centered arm. Furthermore, offset arms allow the engine 104 to be located at various longitudinal positions between (e.g., lateral to) the lift arm assemblies 110. Such versatility with engine positioning may allow tuning of loader weight distribution/center of gravity characteristics and thus reduce or avoid the need to add additional counter-weights to the vehicle. Again, visibility may also benefit from positioning the operator 203 (i.e., the operator platform 202) behind (aft of) the transverse lift arm pivot axis 113.

Figure 2:
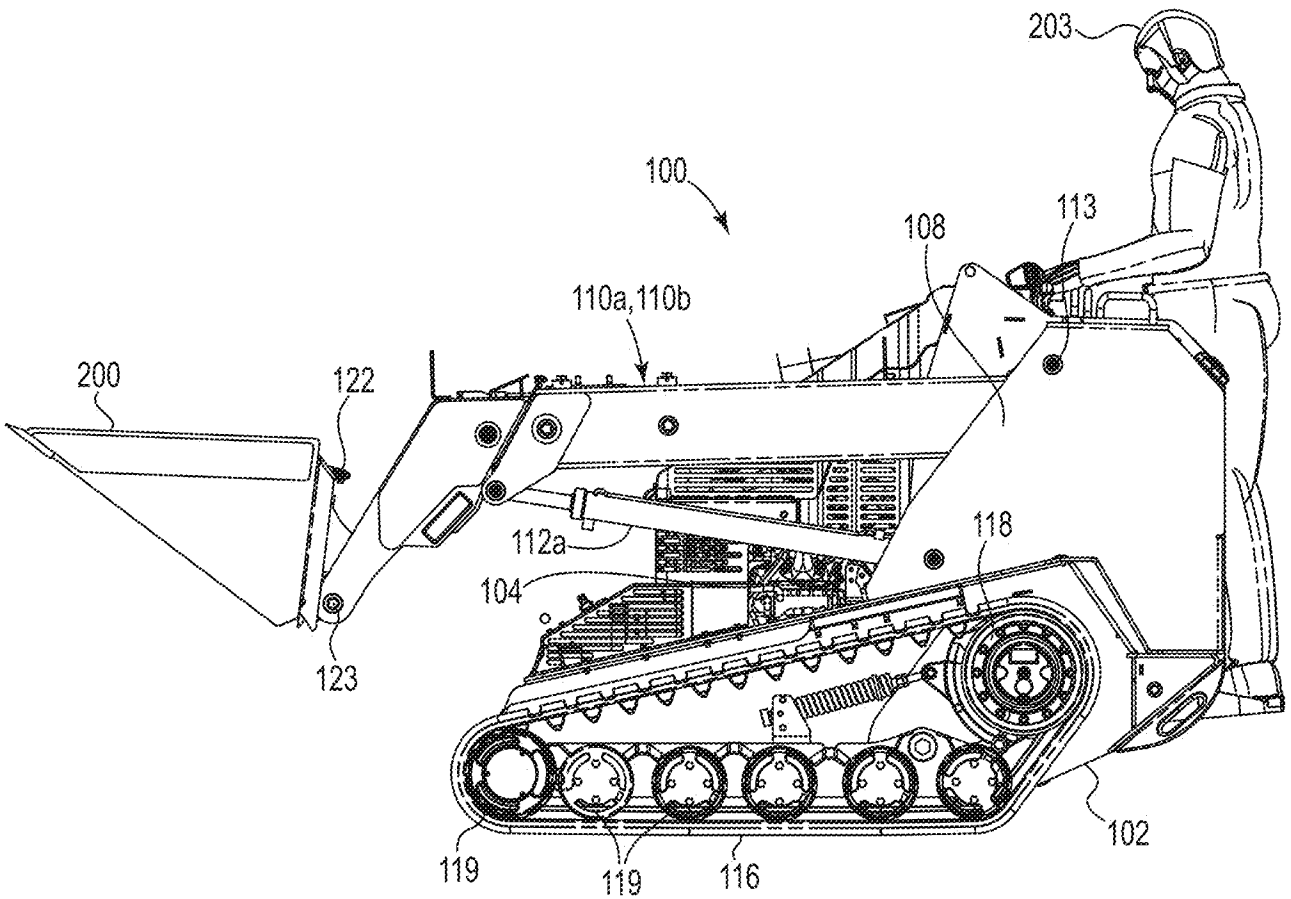
FIG. 2 is a side elevation view of the loader of FIG. 1 (e.g., lift arm assemblies fully retracted), but with the lift arm assemblies lifted to an intermediate elevated position.

With reference again to FIG. 1, the operator may cause the loader 100 to pick up a load of material (e.g., dirt, debris, etc.) with the bucket 200 and then elevate the bucket to an intermediate or transport position as shown in FIG. 2. Movement to the intermediate position of FIG. 2 may be accommodated by a control located on the control console 120 (see, e.g., FIG. 12 and accompanying description below) that causes the actuators 112 to extend, thereby raising the bucket 200 to the position shown in FIG. 2. If necessary, the operator may also command the bucket 200 to tip rearwardly by retracting the tilt actuators 124 (see FIG. 4). In some embodiments, the loader may include a controller (see, e.g., controller 502 in FIG. 14A) adapted to adjust the tilt actuators 124 as the lift actuators 112 are extended to maintain the bucket it a generally constant orientation.

Figure 3:
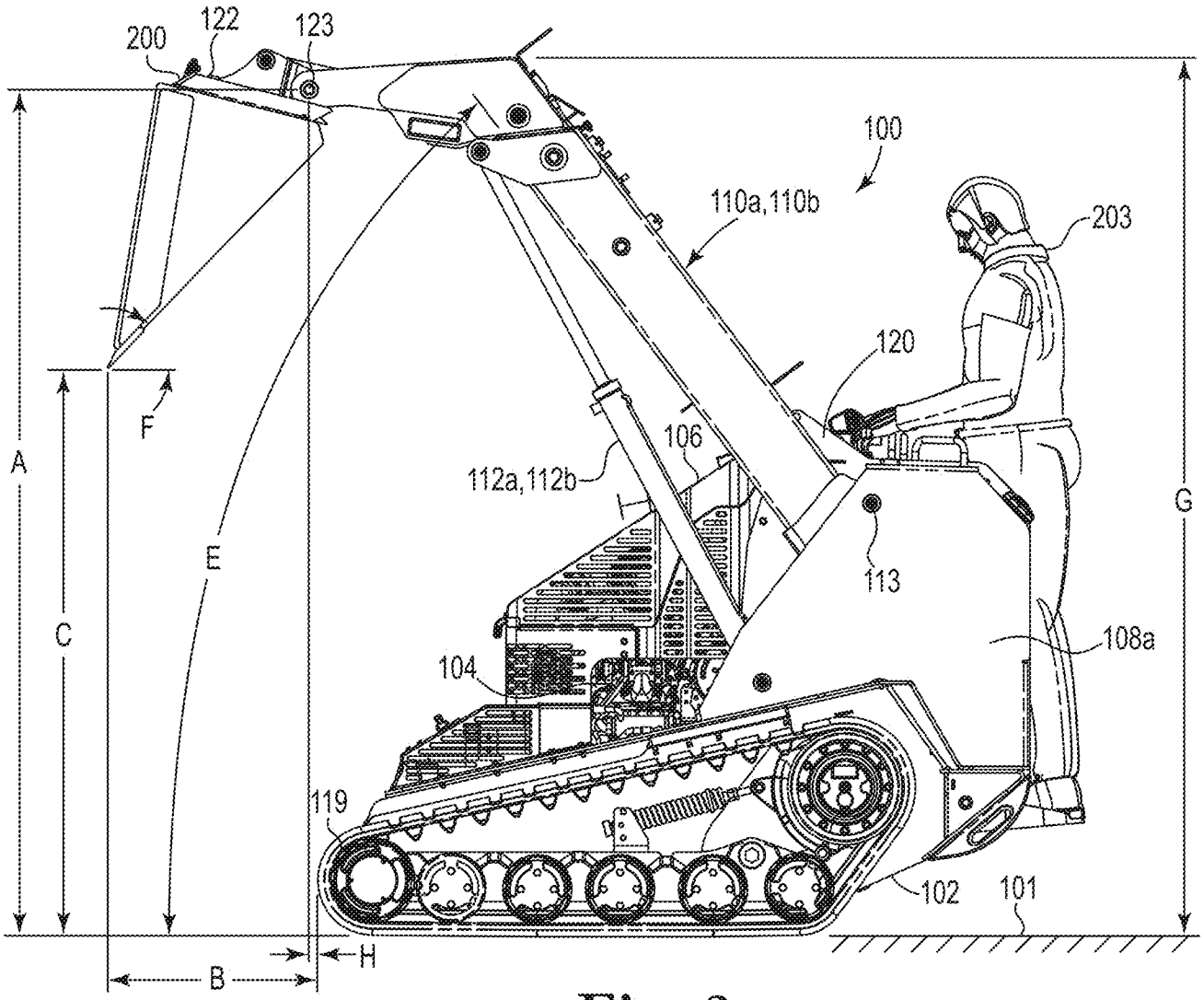
FIG. 3 is a side elevation view of the loader of FIG. 1 (e.g., lift arm assemblies fully retracted), but with the lift arm assemblies lifted to a maximum or fully raised position.
Figure 4:
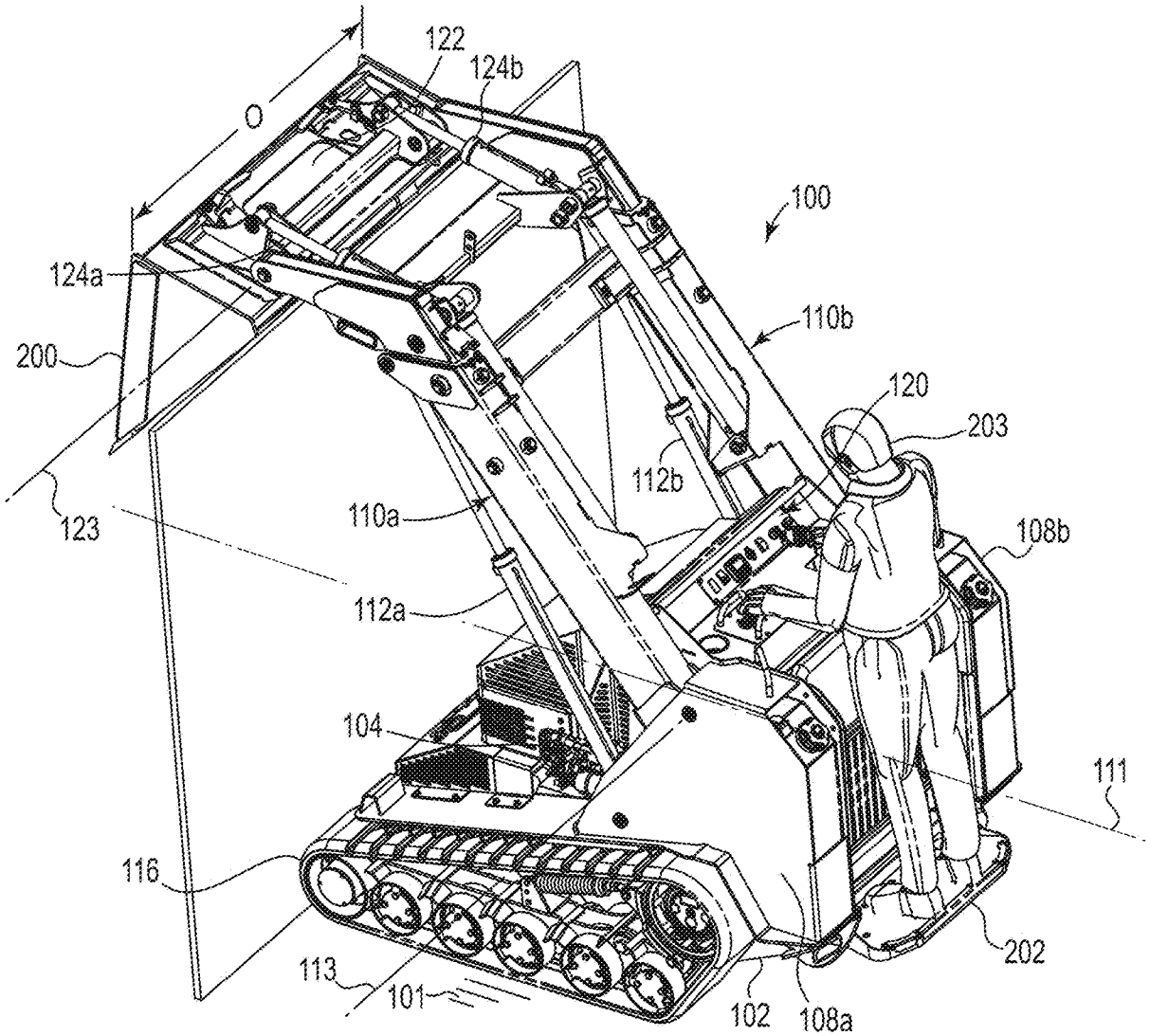
FIG. 4 is a perspective view of the loader of FIG. 3.

As the loader 100 approaches an elevated dump location (e.g., dump truck or other elevated surface), the bucket 200 may be raised to a higher position as shown in FIGS. 3 and 4 by further extending the lift actuators 112 as shown. To dump the bucket contents, the tilt actuators 124 may be extended.

While not wishing to be bound to any particular embodiment, the exemplary loader 100 may provide lift arm assemblies 110 that (when retracted as shown) can pivot to the maximum raised position as shown in FIG. 3. When in this position, the lift arm assemblies 110 may be oriented at an angle E measured from horizontal of 35-40 degrees (e.g., 37 degrees). Moreover, the attachment plate 122 (e.g., measured at the pivot axis 123) may be at an elevation A of 90-100 inches (e.g., 98 inches) yielding a dump height C of 65-75 inches (e.g., 70 inches). When in this maximum raised position, the loader may also have a maximum height G of 100-110 inches (e.g., 106 inches). As FIG. 3 further illustrates, the loader 100 may accommodate these elevations with a horizontal reach B, measured from the forwardmost edge of the loader (e.g., forwardmost edge of the tracks 116) to the forwardmost edge of the bucket 200, of 20-30 inches (e.g., 25 inches), assuming a maximum bucket tilt angle F of 45 degrees. Such an exemplary configuration may also result in a pin reach H (horizontal distance from the forwardmost edge of the frame/track 116 to the pivot axis 123) of 1-4 inches (e.g., 1 inch). Once again, these dimensions are exemplary only and may vary for other loader configurations.

In order to provide even increased versatility and greater lift and reach, loaders in accordance with embodiments of the present disclosure may further provide boom/lift arm assemblies 110 of variable (e.g., extendible) length as described below and illustrated primarily in FIGS. 5-7. In the illustrated embodiments, this variable length is achieved by configuring each lift arm assembly (110*a*, 110*b*) to include both an elongate rear lift arm 150 (having front and rear ends, wherein the rear end is equivalent to the rear end of the arm assembly) and an elongate front lift arm 152 (also having front and rear ends, wherein the front end is equivalent to the front end of the arm assembly). Each front lift arm 152 (e.g., the rear end of each front lift arm) is telescopically received within the rear lift arm 150 (e.g., within the front end of the rear lift arm) such that a distance between the rear end of the rear lift arm and the front end of the front lift arm (e.g., a length of the arm assembly) is variable. The rear end of each rear lift arm 150 may be pivotally connected to its respective upright 108 of the lift frame 102 at the lift arm pivot axis 113. In one embodiment, each rear lift arm 150 forms a tubular member (e.g., a rectangular tube having a greater dimension in the vertical or lift direction), wherein the respective front lift arm 152 may be received therein such that the front lift arm 152 may translate along and within the rear lift arm 150 from a fully retracted position (see, e.g., FIG. 2), to a fully extended position (see, e.g., FIG. 5) or any intermediate position therebetween.

While described as being a tubular member that receives the front lift arm 152 therein, those of skill in the art will realize that the shape of the rear lift arm 150 does not necessarily need to define an enclosed cross section. For example, alternative embodiments of the rear lift arm 150 may form a U- or C-channel in cross section without departing from the scope of this disclosure. In fact, any shape that permits the translation of the front lift arm 152 relative to the rear lift arm 150, while also providing the needed structural integrity to allow the lift arm assemblies 110 to lift the predetermined load when fully extended, is contemplated.

To extend and retract the lift arm assemblies 110*a*, 110*b*, each may include an extension actuator 154 (154*a*, 154*b*, see FIG. 7) adapted to extend and retract the front lift arm 152 relative to the rear lift arm 150. In the illustrated embodiment, each extension actuator 154 is configured as a linear hydraulic cylinder having a rear (cylinder) end attached to the rear lift arm 150, and a forward (piston rod) end attached to the front lift arm 152. By extending the extension actuators 154 in unison, the lift arm assemblies 110 may extend from their fully retracted positions shown in FIGS. 1-4, to their fully extended positions shown in FIGS. 5-7. In the illustrated embodiment, the lift arm assemblies may extend by a distance J (see FIG. 6) of 30-35 inches (e.g., 31 inches).

By allowing the lift arm assemblies 110 to extend from the length provided in the retracted position, the reach and lift height of the loader 100 may be increased accordingly. For example, with the lift arm assemblies 110 in the fully extended and fully raised position as shown in FIG. 6, the attachment plate 122 (e.g., the pivot axis 123) can now reach an elevation A of 120-130 inches (e.g., 123 inches) yielding a dump height C of 90-100 inches (e.g., 95 inches). As this figure further illustrates, the loader 100 may accommodate these elevations with a horizontal reach B now of 50-60 inches (e.g., 58 inches), including a pin reach H of 15-25 inches (e.g., 20 inches). Finally, with the lift arm assemblies 110 fully extended and raised as shown in FIG. 6, the maximum height G is now 125-135 inches (e.g., 131 inches).

In one or more embodiments, one or both of the lift arm assemblies 110 may include at least one carrier 115 (shown only in FIG. 1) extending between the rear and front lift arms 150, 152. The carrier 115 may be configured to guide and restrain cables, wires, hoses, etc. extending between the rear lift arms 150/frame 102 and the front lift arms 152 as the lift arm assemblies 110 move between their fully retracted positions and their fully extended positions.

Loaders in accordance with embodiments of the present disclosure may utilize dual lift arm assemblies (e.g., left and right) with corresponding dual actuators. For instance, the loader 100 may include left and right lift actuators 112, left and right tilt actuators 124, and left and right extension actuators 154. Such a dual configuration may, as stated above, provide various benefits including better visibility of the tool area, e.g., along a centerline viewing lane of the loader 100 (as opposed to configurations using a single, centrally-mounted arm assembly/actuator). To ensure even actuation pressures, each actuator may be hydraulically connected in parallel to its corresponding actuator (e.g., lift actuator 112*a* is hydraulically connected in parallel to lift actuator 112*b*) so that each actuator of each pair receives equal pressure during actuation. In other embodiments, the loader 100 could accommodate the various arm assembly movements using a single lift actuator 112, a single tilt actuator 124, and/or a single extension actuator 154.

In order to avoid binding during extension and retraction of the front lift arms 152 of each lift arm assembly 110, one or both of the front or rear lift arms may include anti-friction pads. For example, in the embodiment illustrated in FIG. 7, each of the rear lift arms 150 may each include a cap 156, a cross section of which is provided in FIG. 8 (taken along line 8-8 of FIG. 7). As shown in this cross section, the inboard side of each cap (as well as other locations along inner surfaces of the rear lift arms) may include wear pads 158 to reduce friction during lift arm extension/retraction. Moreover, along one or more sides (e.g., outboard and top sides) of each cap 156 is a threaded adjuster 160. The adjuster 160 may include a wear pad 159 that may be tightened against the front lift arm 152 by turning a head 162 of the adjuster. As a result, undesired clearances between the front and rear lift arms 152, 150 may be minimized by periodic tightening of the adjusters 160.

The wear pads 158, 159 may be made of most any acceptable bearing material. For example, the pads may include thermoplastic resins such as Delrin acetyl resin distributed by E. I. du Pont de Nemours and Company of Wilmington, Del., USA. Other potential wear pad materials include ultra-high molecular weight (UHMW) polyethylene, nylon, and powdered metal, to name a few.

Figure 5:
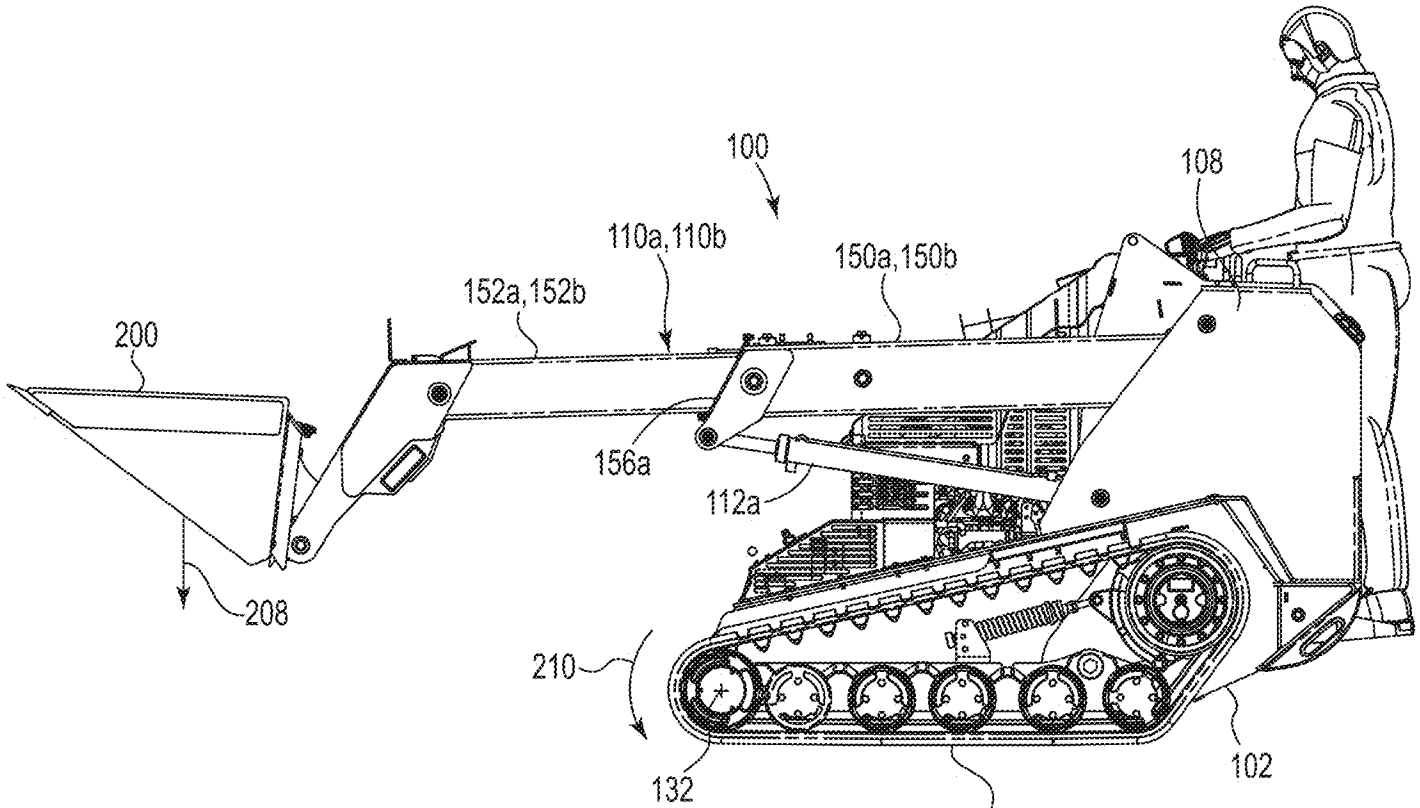
FIG. 5 is a side elevation view similar to FIG. 2 (e.g., lift arm assemblies at an intermediate elevated position), but with the lift arm assemblies in a fully extended position.
Figure 6:
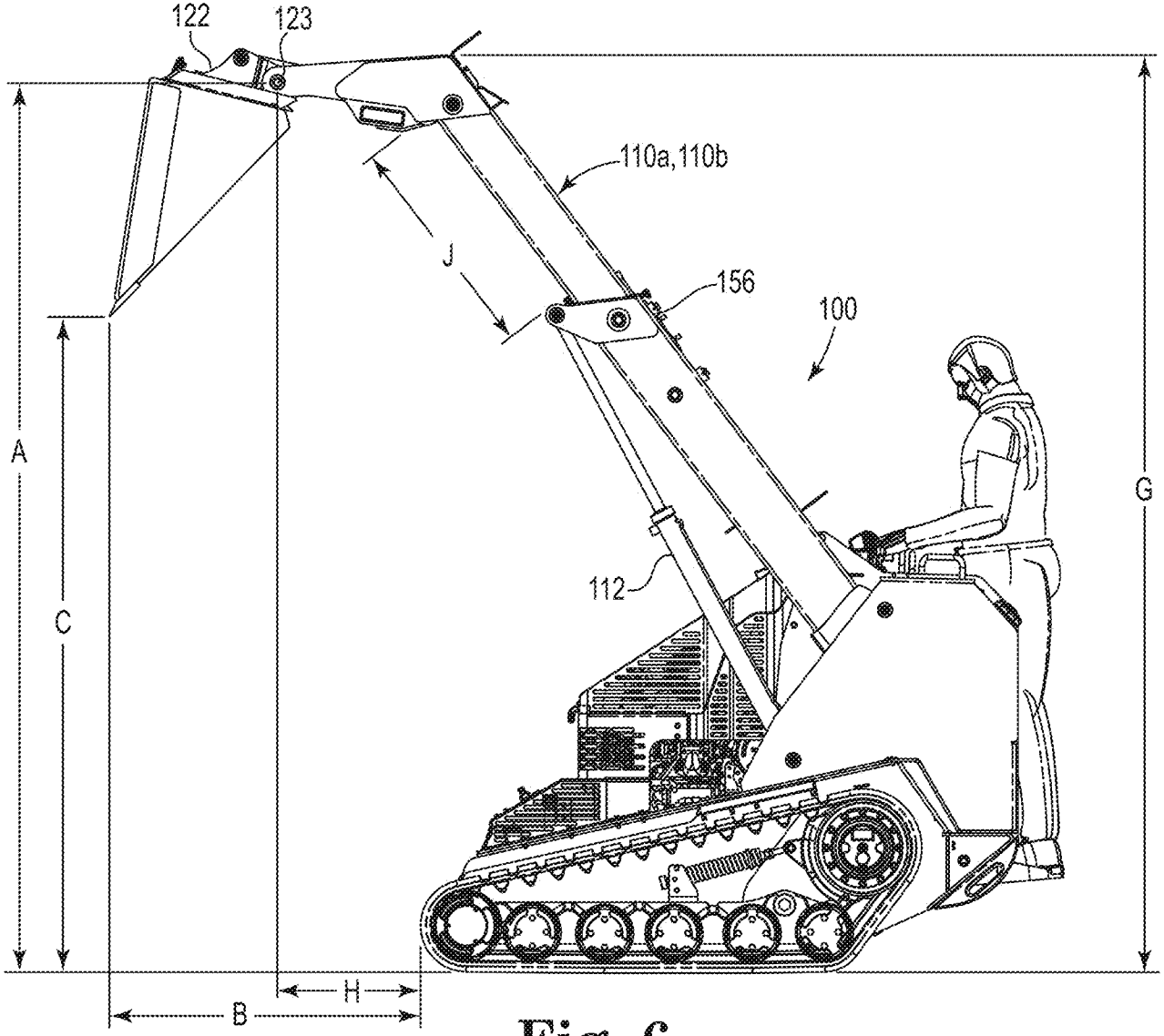
FIG. 6 is a side elevation view similar to FIG. 3 (e.g., lift arm assemblies at the fully raised position), but with the lift arm assemblies shown in the fully extended position.
Figure 7:
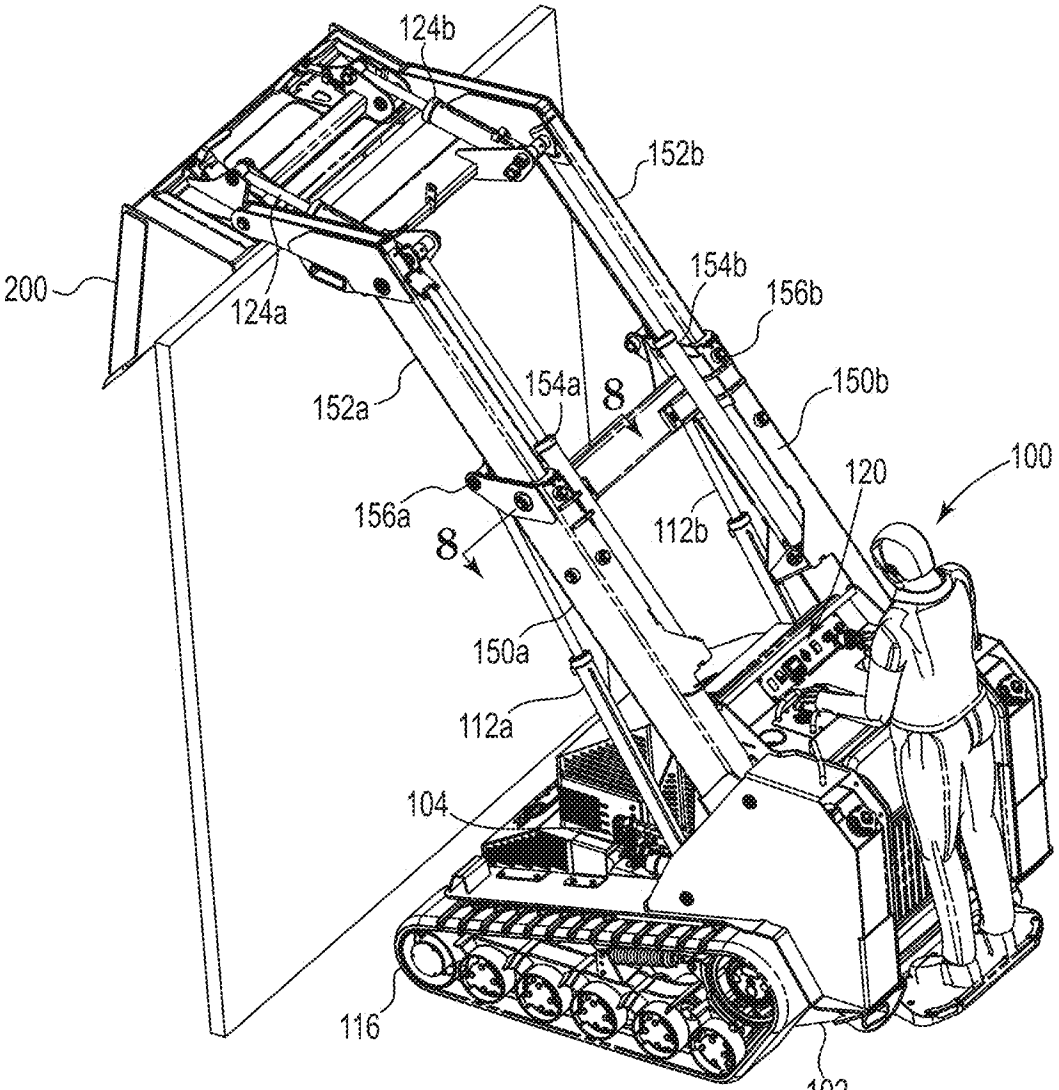
FIG. 7 is a perspective view of the loader of FIG. 6.
Figure 8:
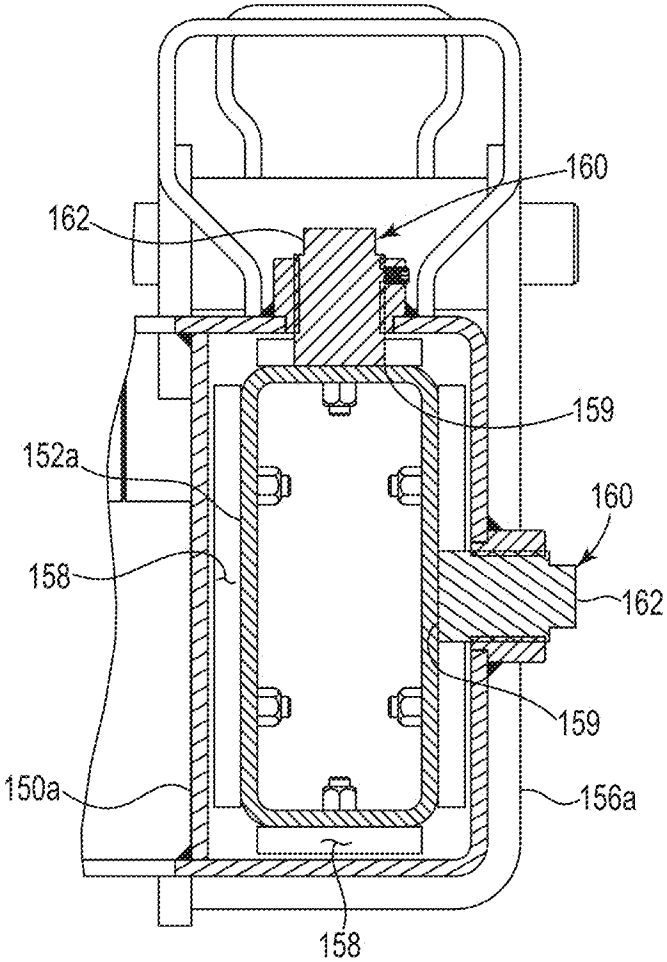
FIG. 8 is a cross sectional view taken along line 8-8 of FIG. 7.

As one of skill may recognize, the extension of the lift arm assemblies 110 from the retracted position of FIGS. 1-4 to the extended position of FIGS. 5-7 increases the moment on the loader 100, and thus may correspondingly decrease the magnitude of the load that may be satisfactorily lifted. For instance, in the illustrated tracked embodiment, increasing the lift arm assembly length by the distance J (see FIG. 6) of 31 inches could decrease the rated operating capacity (ROC) of the loader 100 from 2000 pounds to 1000 pounds (assuming additional counterweights or the like are not utilized on the loader when the arm assemblies are in the extended position).

While described herein above in the context of a bucket 200 and the desire to increase the lift height of the same, other tools may also benefit from the increased reach provided by the exemplary loader 100. For instance, in FIGS. 9-10, the tool is shown as a fork lift 300. By providing the extended reach described herein above, the loader 100 may place pallets 302 (e.g., defining a width 10 of about 40 inches) across an elevated flatbed trailer 304 as shown (e.g., defining a width 11 of about 102 inches and a height 12 of about 58 inches).

Figure 11:
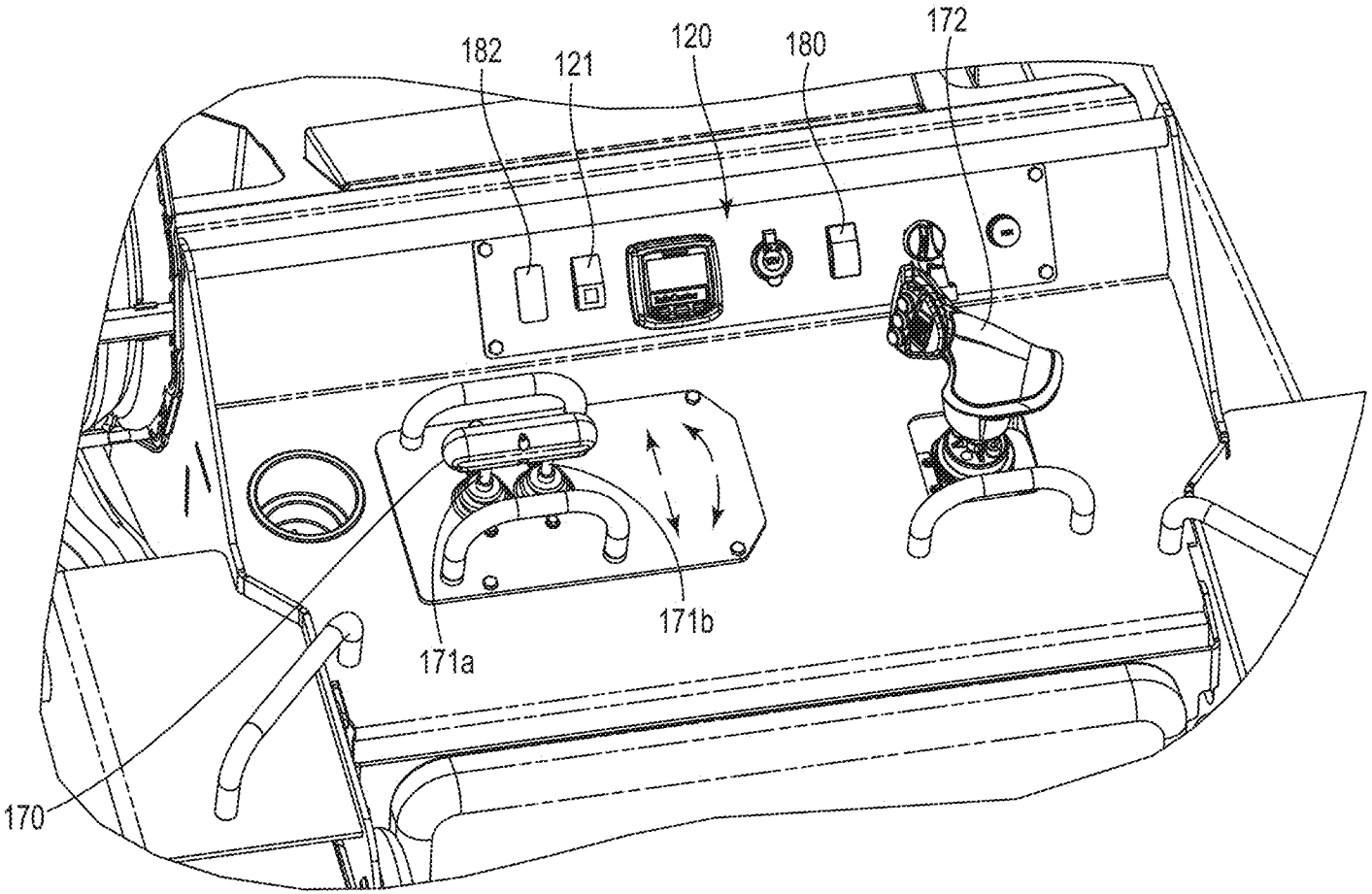
FIG. 11 is a perspective view of an exemplary control console for use with a SOWB loader in accordance with embodiments of this disclosure.
Figure 12:
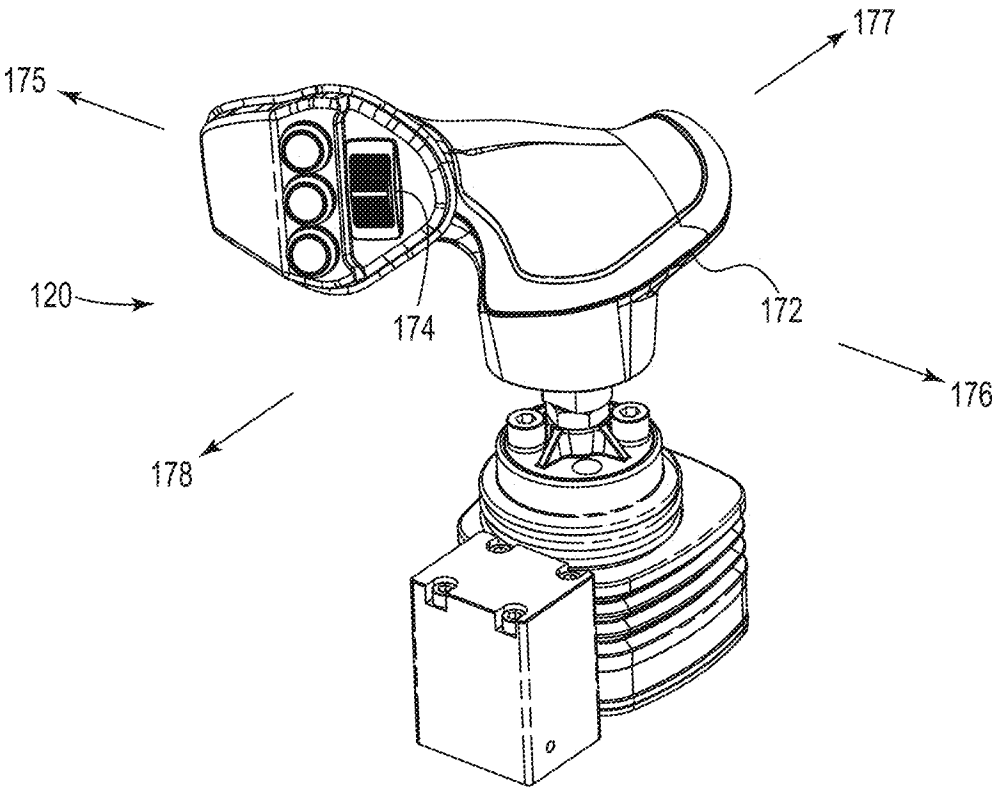
FIG. 12 is a perspective view of a portion of the control system of FIG. 11 illustrating a boom control joystick.

FIGS. 11-12 illustrate the control console 120 in accordance with embodiments of the present disclosure. As shown in FIG. 11, the console may include directional control levers 171 (171*a*, 171*b*) operable to intuitively control the ground speed and direction of the loader 100. In this embodiment, the control levers may be connected via a T-shaped handle 170 that may be displaced forwardly and rearwardly (to drive the loader forwardly and rearwardly, respectively), and/or twisted clockwise (for a right turn) or counterclockwise (for a left turn). The control console 120 may also include multiple switches for various other purposes. For example, the control console 120 may include a throttle switch 180 and a brake enable switch 121.

Accessible with the opposite hand is a joystick 172 that may intuitively control operation of the boom. An enlarged view of the joystick 172 is shown in FIG. 12. As shown in this view, the joystick 172 may include controls to manipulate (e.g., retract/lower and extend/lift) the lift arm assemblies 110 (e.g., via the lift actuators 112 and extension actuators 154). For example, the joystick may be pushed forwardly (e.g., in the direction 175) to lower the boom (e.g., retract the lift actuators 112), and pulled rearwardly (e.g., in the direction 176) to lift or raise the boom (e.g., extend the lift actuators). Moreover, the tilt actuators 124 may be controlled by left and right movement of the joystick 172. For instance, movement of the joystick to the left (e.g., in the direction 178) may cause the tilt actuators 124 to retract and curl the bucket 200, while movement to the right (e.g., in the direction 177) may cause the tilt actuators to extend and dump the contents of the bucket. Still further, the joystick 172 may include a thumb-actuated rocker switch 174 that may be pressed near its top to extend the extension actuators 154, or near the bottom to retract the extension actuators 154. Other controls may also be incorporated into the joystick 172 as shown in FIG. 12, or into other areas of the control console 120 as shown in FIG. 11.

Figure 14A:
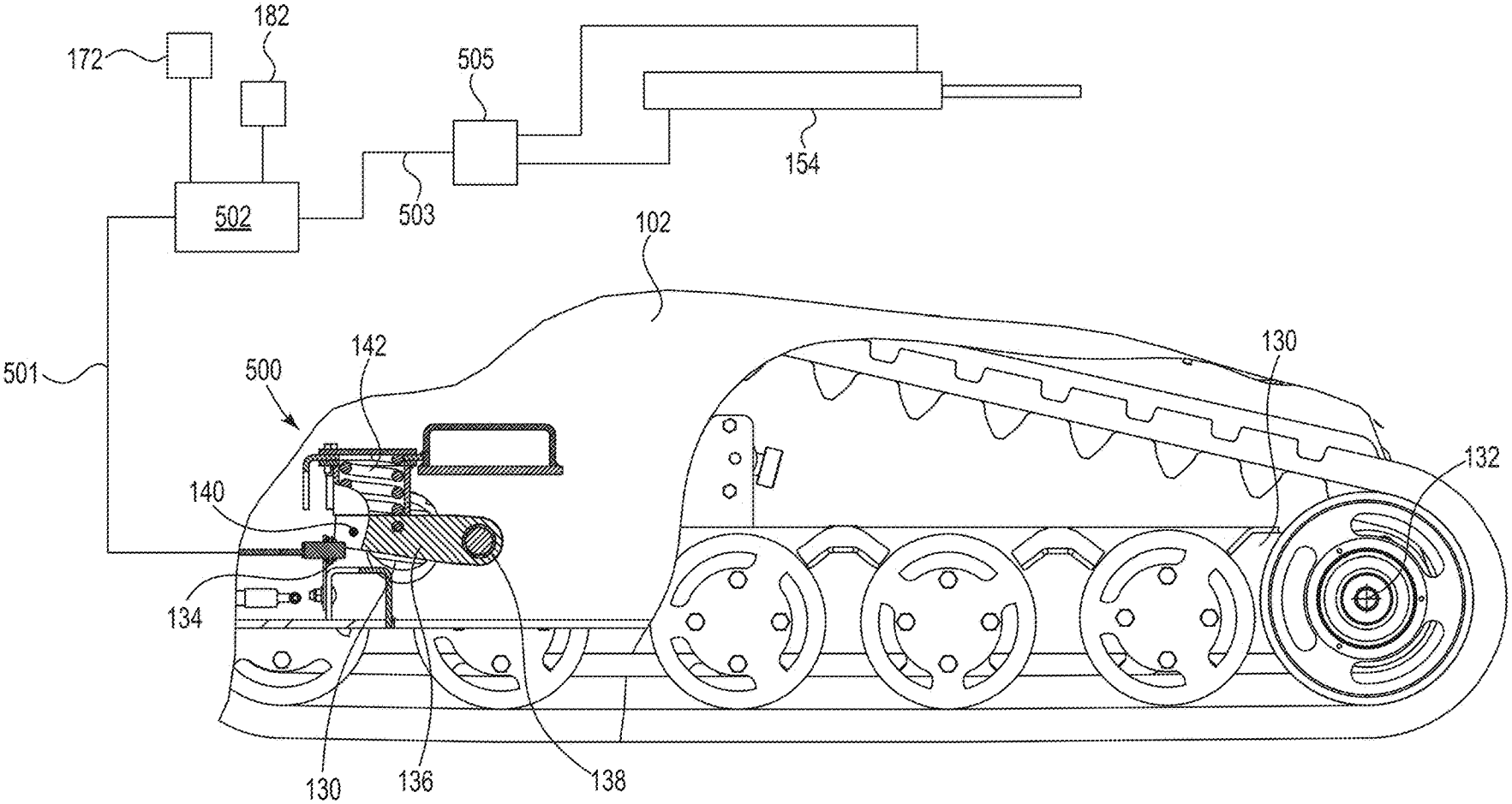

In some embodiments, the loader may be configured as a drive-by-wire vehicle in which some or all operator inputs are provided as electronic signals to an electronic controller (see, e.g., controller 502 in FIG. 14A). The controller may then apply pre-programmed logic and generate output commands to the various actuators in response thereto. For instance, upon receiving a boom extend command, the controller may evaluate the status of various interlocks, as well as any information regarding tool load. If any information is determined to be out of bounds, the controller may prevent extension or otherwise limit extension accordingly. If the controller determines that all parameters are within bounds, it may issue an "open" command to the hydraulic valve that extends the extension actuators. In other embodiments, the controls may be entirely manual (e.g., pilot-controlled) or a combination of manual and electronic control. For instance, in one embodiment, the traction (propulsion) control and arm assembly extension may be electronically controlled, while lift and curl (tilt) are manually controlled.

By providing the loader 100 with extendible arm assemblies, it may be possible to lift a given tool load with the arm assemblies retracted. However, if the arm assemblies 110 are then extended, the same tool load will increase the resultant moment on the loader 100. As one of skill may appreciate, if the magnitude of this moment exceeds a predetermined threshold moment, the loader 100 could begin to pitch or tilt forward. To reduce potential pitching, some embodiments of the loader 100 may include a pitch or tilt detection system adapted to determine when a load applied to/carried by the working tool (e.g., bucket 200) causes a moment on the lift frame that exceeds a predetermined threshold moment. Based upon this determination, the loader may disable or limit further extension of the lift arm assemblies 110 (e.g., limit the extension of the extension actuators 154) beyond a certain position. In addition, the loader 100 may be configured to provide an alert at or before reaching this threshold. Such an alert may include most any suitable indicator. For example, a visual alert 182 may be provided that indicates the moment is approaching a threshold that could result in a weight shift from the rear of the loader 100 toward the front. Such an alert 182 may be located at any suitable position on the loader 100, e.g., on the control console 120 as shown in FIG. 11. While described as a visual alert, such a configuration is not limiting as other embodiments may alternatively or additionally include audible sounds, other visual markers, vibrations, etc. Moreover, in parallel with the alert, the loader (e.g., controller) may initiate other actions as described below.

Figure 13:
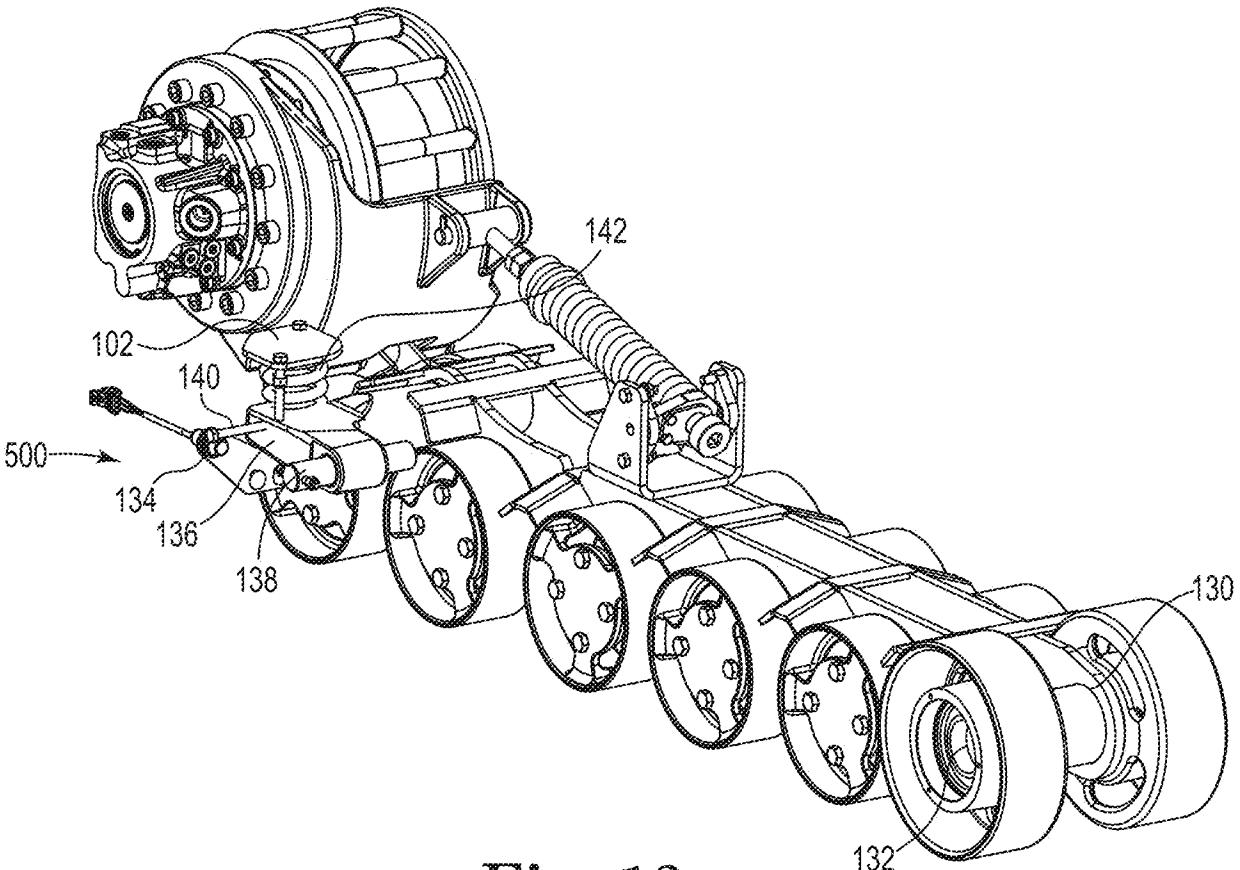
FIG. 13 is an isolated perspective view of an exemplary track frame (e.g., right track frame) for use with a SOWB loader like that of FIG. 1.

While various tilt detection systems are certainly possible, the loader 100 may, in one or more embodiments, include a system 500 associated with one or both of the left and right track frames 130, the right track frame shown in isolation in FIG. 13. The system 500 may include a detector operatively connected to the lift frame that determines when a load borne by a rear portion of the associated track 116 drops below a threshold level (indicating the threshold moment on the loader has been reached). When that threshold level is reached, a signal 501 is provided to a controller 502 associated with the loader 100 (controller schematically illustrated in FIG. 14A). Upon receipt of the signal 501, the controller 502 may generate a disable signal 503 to one or more hydraulic valves 505 to effectively limit further extension of the extension actuators 154 (and/or alternatively, the lift actuators 112). Additionally, the controller 502 may activate the alert (e.g., visual alert 182 described above and shown diagrammatically in FIG. 14A) to notify the operator before or at a time that the threshold moment on the loader is reached.

The detection system 500 may thus disable further extension of the lift arm assemblies before the loader 100 reaches a threshold tilting condition. In other embodiments, the loader could indirectly estimate that loader tilt is approaching the threshold moment by, for example, detecting hydraulic pressure in the lift actuators 112 and monitoring the extension of the extension actuators 154. With this information, the controller 502 could calculate tool load and then limit further extension of the extension actuators 154. Other methods, e.g., directly measuring load at the tool and/or lift arms could also be used to limit lift arm extension. In certain embodiments, the threshold moment may be somewhat tunable, e.g., via controller programming and/or via adjustment of the detector 134 location.

Figure 14B:
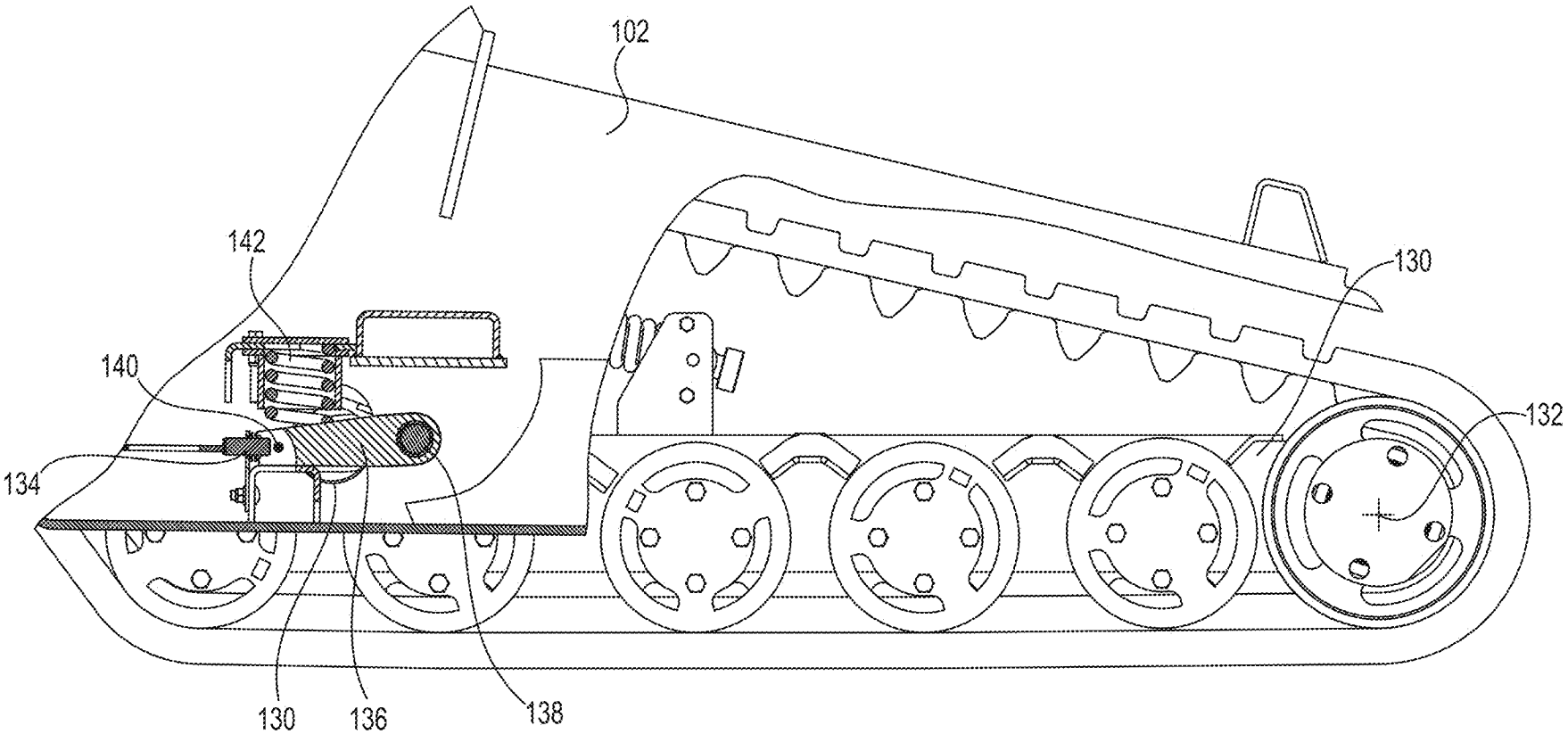

In the embodiment illustrated in FIGS. 13, 14A, and 14B, the detection system 500 may include most any type of detector 134 (e.g., sensor or switch) that can detect movement of the lift frame 102 relative to the track frame 130. For example, the detector 134 may include a proximity sensor, a photoelectric sensor, a pressure sensor, string potentiometer ("string pot resistance sensor"), and/or a switch (e.g., a reed switch).

In the illustrated embodiment, the detection system 500 may be configured to operatively detect a particular position of the lift frame 102 relative to the track frame 130 (e.g., due to relative pivoting of the two frames about the front pivot axis 132). This detection can be calibrated to correspond to the threshold moment being approached and/or reached. While illustrated and described as being located at a specific location on the loader 100, the detection system/detector could be located at most any position without departing from the scope of this disclosure. Moreover, while shown only with respect to the right track frame in FIGS. 13-14B, a detector could, in addition or alternatively, be associated with the left track frame of the loader 100. Still further, in other embodiments, the detector could be positioned between the left and right sides of the loader, and/or anywhere else that suitably senses relative movement between the lift frame and the track frame 130. For example, using detectors on each of the track frames may provide additional advantages, e.g., may provide the loader with feedback regarding lateral leaning.

In the embodiment illustrated in FIGS. 13 and 14A-14B, the exemplary detection system 500 may include the detector 134 (e.g., a sensor) coupled to the lift frame 102 (e.g., proximate the rear end of the lift frame), and a target 140 connected to the track frame 130. Again, while shown in association with the right track frame, the detection system could also or alternatively include a detector and target associated with the left track frame. Moreover, the relative positions of the detector and target could be switched (e.g., detector connected to the track frame and target connected to the lift frame). Regardless, the detector 134 may be configured to detect proximity of the target 140 such that the alert (e.g., alert 182) may be provided (e.g., transmitted to the control console 120) as already described herein when the detector 134 determines that the target has moved to a position close to the detector 134.

With reference now to FIGS. 14A and 14B, the target 140 may be attached or otherwise integral with an arm 136 rigidly connected to the track frame 130 and pivotally and translatably attached to the lift frame 102 (e.g., via a rear track pivot 138; see also FIG. 13). In the illustrated embodiment, the lift frame apertures (not shown) that receive the rear track pivot 138 may be oversized or obround to provide a slight clearance (e.g., 0.03-0.05 inches) in which the rear track pivot may translate. This clearance allows the rear track pivot 138 to move relative to the lift frame 102 as the two frames pivot relative to one another about the front pivot axis 132. Furthermore, a resilient member 142 may be operatively attached between the lift frame 102 and the arm 136. The resilient member 142 may include any suitable material that stores energy such as, e.g., a compression spring, an elastomeric element, etc. The resilient member 142 may apply a downward force to the track frame 130 (reacted by the lift frame 102) during loader operation.

During normal operation with little or no tool load, machine weight may keep the resilient member 142 compressed and keep the target 140 away from the detector 134 as shown in FIG. 14A. However, when the tool is loaded (e.g., when a tool load 208 (see FIG. 5) is lifted such that a moment 210 is created), the rear of the lift frame 102 may move slightly upwardly relative to the track frame 130 as it pivots about the pivot axis 132 such that the relative distance between the detector 134 and the target 140 changes (e.g., the target 140 may move closer to the detector 134) as shown in FIG. 14B. For example, the lift frame 102 may pivot relative to the track frame 130 (e.g., due to a force applied to the lift arm assemblies 110) about the pivot axis 132 (as stated above, the lift frame 102 may permit some movement of the rear track pivot 138 at this time). Eventually, the pivotal distance may become sufficiently great that the detector 134 registers proximity with the target 140. In other words, the lift frame 102 (which is coupled to the detector 134) may move sufficiently upwards relative to the track frame 130 (which is coupled to the target 140) such that the detector 134 detects the target 140. While described herein as pivotal movement of the target 140 relative to the detector 134, other relative movements (e.g., translation or pivoting away from, instead of toward) are also contemplated. Moreover, the detector could sense the threshold moment in other ways, e.g., by sensing increased pressure/load near the front of the track frame(s).

Accordingly, when the lift frame 102 pivots relative to the track frame 130 about the pivot axis 132, the resilient member 142 may decompress, and the downward load on the rear of the track frame 130 may be reduced. Eventually, the detector 134 becomes sufficiently close to the target 140 that the alert 182 is triggered (e.g., by the controller 502). Once the alert 182 is triggered, the operator may receive the visual indication as described above.

Detection of the target 140 by the detector 134 may be described in different ways. For example, the detector 134 may be said to detect a threshold position of the lift frame 102 relative to the track frame 130 (e.g., after the detector 134 detects the target 140), i.e., the detector 134 may detect the target 140 after the lift frame 102 pivots a certain degree relative to the track frame 130. Alternatively, the detector 134 may be described as detecting the target 140 when a force is applied to the lift arm assemblies 110 at a particular extension, or when the tool load creates a moment about the pivot axis 132 that exceeds the predetermined threshold.

In addition to the visual or audible signal provided by the alert 182, the alert may also, via the controller 502, cause further lift arm extension by the actuators 154 to be disabled, e.g., until tool load/loader tilt is reduced (retraction may still be permitted). In some embodiments, the loader could also disable further elevation of the lift arm assemblies 110, and/or even disable propulsion of the tracks 116.

While specific embodiments of a tilt detection system are shown and described herein, those of skill in the art will realize that such exemplary embodiments, while theoretically acceptable, may require detailed design analysis and testing to ensure that all applicable safety standards and concerns are satisfied, and that net safety is improved. Accordingly, those of skill in the art will realize that the tilt detection systems shown and described herein are theoretical embodiments, and that commercialized tilt detections systems may vary from those shown and described herein.

Figure 15:
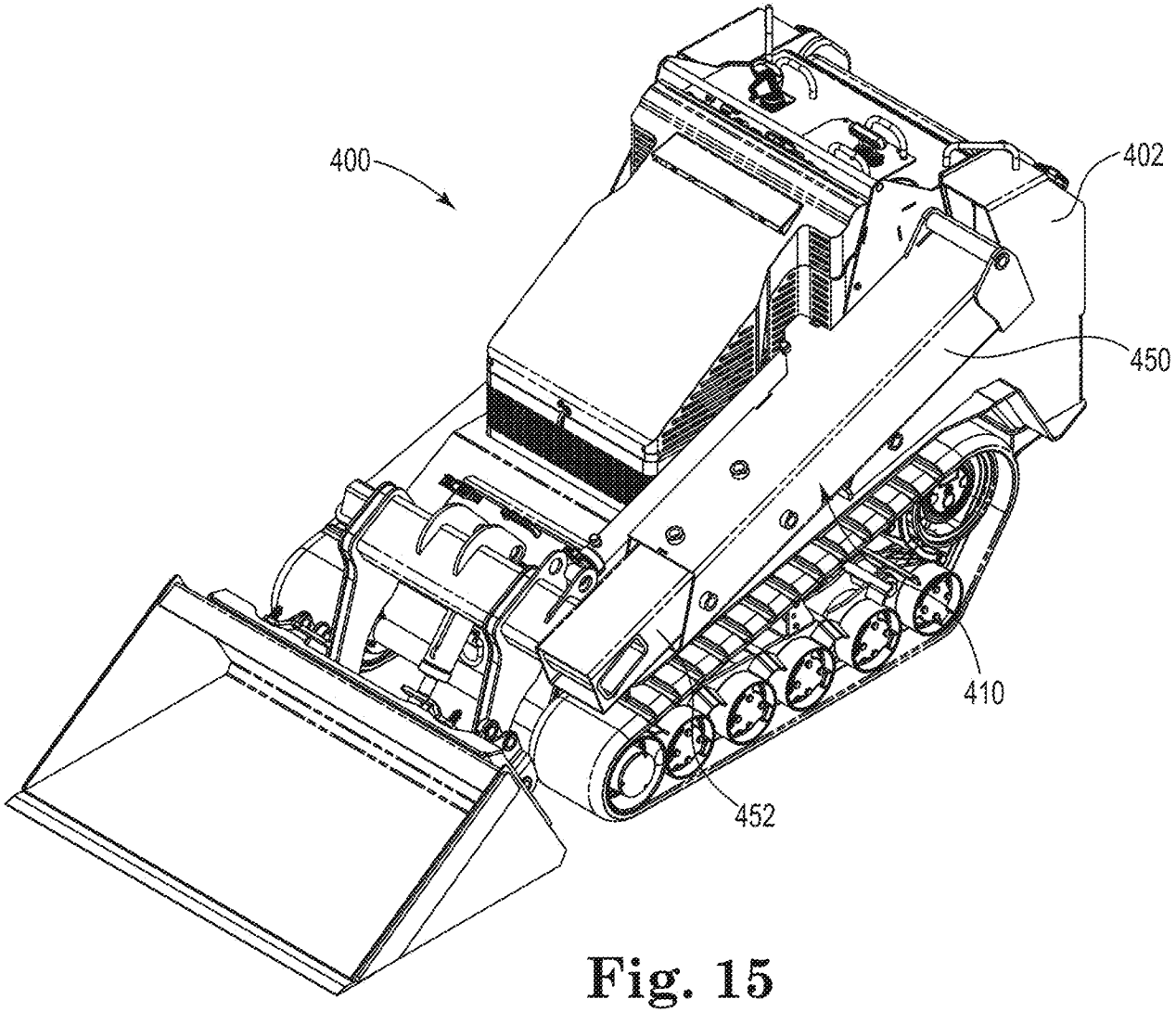
FIG. 15 is a perspective view of a SOWB loader in accordance with another embodiment of the disclosure, wherein the loader includes a single, offset lift arm assembly.

While described herein as utilizing two (left and right) lift arm assemblies, other embodiments may achieve the desired lift and reach using a single laterally offset lift arm assembly. Such an arm assembly could be attached to either the left or right side of the loader (e.g., similar to using only one of the arm assemblies illustrated herein). For example, as shown in FIG. 15, a SOWB loader 400 is shown that includes a lift arm assembly 410 that may be attached to a lift frame 402 on the left side of the loader 400. The offset position of the lift arm assembly 410 may, as with the dual arm loader 100 described above, allow the operator of the loader 400 to maintain visibility of the tool area through the center of the loader 400. The lift arm assembly 410 may include an elongate rear lift arm 450 pivotally attached to the lift frame 402 and an elongate front lift arm 452 that may be telescopically received in the rear lift arm 450 in a manner similar to that already described herein in the context of the loader 100. For example, a rear end of the front lift arm 452 may be telescopically received in a front end of the rear lift arm 450 such that a distance between a rear end of the rear lift arm 450 and a front end of the front lift arm 452 may be varied. The loader 400 may also include any of the features already identified and described herein in accordance with the embodiments of FIGS. 1-14B.

The complete disclosure of the patents, patent documents, and publications cited herein are incorporated by reference in their entirety as if each were individually incorporated. In the event that any inconsistency exists between the disclosure of the present application and the disclosure(s) of any document incorporated herein by reference, the disclosure of the present application shall govern.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. A utility loader comprising:

a lift frame carrying a prime mover, the lift frame including left and right sides;

a track frame comprising ground engaging members, wherein the track frame is pivotally attached to the lift frame at a frame pivot axis such that the lift frame is adapted to pivot relative to the track frame about the frame pivot axis, wherein at least one of the ground engaging members is powered by the prime mover to propel the lift frame over a ground surface, and wherein the frame pivot axis extends transversely between the left and right sides of the lift frame;

a detector operatively connected to one of the lift frame and the track frame, wherein the detector is adapted to detect a threshold pivot position of the lift frame relative to the track frame;

a control console located at or near a rear end of the lift frame, the control console carrying controls adapted to be manipulated by an operator either: standing on a platform mounted near the rear end of the lift frame; or walking behind the lift frame;

a lift arm assembly attached to at least one of the left and right sides of the lift frame, wherein the prime mover is positioned on the lift frame at a location lateral to the lift arm assembly, and wherein the lift arm assembly comprises:

an elongate rear lift arm including a front end and a rear end, wherein the rear end of the rear lift arm is pivotally attached to the lift frame at a transverse lift arm pivot axis;

an elongate front lift arm also including a front end and a rear end, wherein the rear end of the front lift arm is telescopically received in the front end of the rear lift arm such that a distance between the rear end of the rear lift arm and the front end of the front lift arm is variable; and an extension actuator adapted to extend or retract the front lift arm relative to the rear lift arm; and a working tool carried on the front end of the front lift arm.

2. The loader of claim 1, wherein the platform is located aft of the transverse lift arm pivot axis.

3. The loader of claim 1, further comprising a tilt detection system, wherein the tilt detection system comprises the detector and is adapted to determine when a load carried by the working tool causes a moment on the lift frame that exceeds a predetermined threshold moment.

4. The loader of claim 1, further comprising a mounting structure pivotally attached to the front ends of the front lift arms, the mounting structure adapted to connect the working tool to the front lift arms.

5. The loader of claim 4, further comprising a tilt actuator adapted to pivot the mounting structure relative to the left and right front lift arms.

6. A utility loader comprising:

a lift frame carrying a prime mover;

a track frame comprising ground engaging members, wherein the track frame is movably attached to the lift frame, wherein at least one of the ground engaging members is powered by the prime mover to propel the lift frame over a ground surface;

a proximity sensor operatively connected to one of the lift frame and the track frame;

a target operatively connected to the other of the lift frame and the track frame;

a control console located at or near a rear end of the lift frame, the control console carrying controls adapted to be manipulated by an operator either: standing on a platform mounted near the rear end of the lift frame; or walking behind the lift frame;

left and right lift arm assemblies attached to left and rights sides of the lift frame, respectively, wherein the prime mover is located at a position on the lift frame that is between the left and right lift arm assemblies, and wherein each of the left and right lift arm assemblies comprises:

an elongate rear lift arm including a front end and a rear end, wherein the rear end of the rear lift arm is pivotally attached to the respective side of the lift frame at a transverse lift arm pivot axis;

an elongate front lift arm also including a front end and a rear end, wherein the rear end of the front lift arm is telescopically received in the front end of the rear lift arm such that a distance between the rear end of the rear lift arm and the front end of the front lift arm is variable; and an extension actuator adapted to extend or retract the front lift arm relative to the rear lift arm; and a working tool carried on the front ends of the front lift arms, wherein the proximity sensor is adapted to detect proximity to the target when a load applied at the working tool creates a moment on the lift frame relative to the track frame that exceeds a predetermined threshold moment.

7. The loader of claim 6, wherein the platform is located aft of the transverse lift arm pivot axis.

8. The loader of claim 6, wherein the track frame is pivotally attached to the lift frame at a front pivot axis proximate a front end of the lift frame, the lift frame adapted to pivot relative to the track frame about the front pivot axis.

9. The loader of claim 8, wherein the proximity sensor is operatively connected to the lift frame proximate the rear end of the lift frame and the target is operatively connected the track frame, wherein the proximity sensor is adapted to detect proximity to the target when a load applied at the working tool creates a moment on the lift frame about the front pivot axis that exceeds a predetermined threshold moment.

10. The loader of claim 9, further comprising a controller adapted to issue an alert when the proximity sensor detects the target.

11. The loader of claim 8, wherein the working tool comprises a bucket or a fork.

12. The loader of claim 6, further comprising a mounting structure pivotally attached to the front ends of the front lift arms, the mounting structure adapted to connect the working tool to the front lift arms.

13. The loader of claim 12, further comprising a tilt actuator adapted to pivot the mounting structure relative to the left and right front lift arms.

14. A utility loader comprising:

a lift frame comprising a front end and a rear end, the lift frame carrying a prime mover;

a track frame comprising ground engaging members, wherein the track frame is pivotally attached to the lift frame such that the track frame pivots, relative to the lift frame, about a front pivot axis proximate the front end of the lift frame, the track frame further comprising an arm pivotally and translatably connected to the lift frame at a rear track pivot;

a detector connected with one of the lift frame and the arm, the detector located proximate the rear end of the lift frame;

a target connected with the other of the lift frame and the arm;

a platform attached to the rear end of the lift frame;

a control console located at or near the rear end of the lift frame;

left and right lift arm assemblies attached to left and rights sides of the lift frame, respectively, wherein each of the left and right lift arm assemblies comprises:

an elongate rear lift arm including a front end and a rear end, wherein the rear end of the rear lift arm is pivotally attached to the respective side of the lift frame at a transverse lift arm pivot axis;

an elongate front lift arm also including a front end and a rear end, wherein the rear end of the front lift arm is telescopically received in the front end of the rear lift arm such that a distance between the rear end of the rear lift arm and the front end of the front lift arm is variable;

a lift actuator connected to the lift frame and to the rear lift arm, the lift actuator adapted to pivot the rear lift arm relative to the lift frame about the transverse lift arm pivot axis;

an extension actuator connected to the rear lift arm and the front lift arm, the extension actuator adapted to extend and retract the front lift arm relative to the rear lift arm; and a working tool carried on the front ends of the left and right front lift arms, wherein the detector is adapted to detect the target when a force applied at the working tool creates a moment about the front pivot axis that exceeds a predetermined threshold moment.

15. The loader of claim 14, wherein the detector is adapted to detect a threshold position of the lift frame relative to the track frame.

16. The loader of claim 14, further comprising a controller adapted to provide an alert when the detector detects the target.

17. The loader of claim 16, wherein the controller is adapted to prevent further extension of the extension actuators when the detector detects the target.

18. The loader of claim 14, further comprising a mounting structure pivotally attached to the front ends of the front lift arms, and at least one tilt actuator connected between the mounting structure and the front lift arms.

19. The loader of claim 18, wherein the working tool is carried on the mounting structure.

20. The loader of claim 14, wherein each of the ground engaging members comprises a track.

21. The loader of claim 14, wherein the track frame comprises independent left and right track frames supporting left and right tracks, respectively.

* * * * *